US011867163B2

(12) United States Patent
Mitchell et al.

(10) Patent No.: US 11,867,163 B2
(45) Date of Patent: Jan. 9, 2024

(54) ELECTRIC DRIVE COMPRESSOR SYSTEM

(71) Applicant: UNICLA INTERNATIONAL LIMITED, Hong Kong (CN)

(72) Inventors: Mark Mitchell, Benowa (AU); Peter Woodfield, Biggera Waters (AU); Chris Conway Lamb, Graceville (AU); Hongqiu Yan, Hong Kong (CN)

(73) Assignee: UNICLA INTERNATIONAL LIMITED, Hong Kong (CN)

( * ) Notice: Subject to any disclaimer, the term of this patent is extended or adjusted under 35 U.S.C. 154(b) by 277 days.

(21) Appl. No.: 17/264,747

(22) PCT Filed: Jul. 22, 2019

(86) PCT No.: PCT/CN2019/097118

§ 371 (c)(1),
(2) Date: Jan. 29, 2021

(87) PCT Pub. No.: WO2020/024836

PCT Pub. Date: Feb. 6, 2020

(65) Prior Publication Data

US 2021/0246892 A1 Aug. 12, 2021

(30) Foreign Application Priority Data

Jul. 30, 2018 (AU) ..... 2018902751

(51) Int. Cl.
*F04B 35/04* (2006.01)
*F04B 53/08* (2006.01)
(Continued)

(52) U.S. Cl.
CPC ..... *F04B 35/04* (2013.01); *F04B 1/12* (2013.01); *F04B 1/14* (2013.01); *F04B 39/06* (2013.01);
(Continued)

(58) Field of Classification Search
CPC ..... F04B 1/12; F04B 1/14; F04B 2205/11; F04B 2205/01; F04B 2205/05; F04B 2205/10; F04B 53/08; F04B 39/06
See application file for complete search history.

(56) References Cited

U.S. PATENT DOCUMENTS 5,215,443 A * 6/1993 Hani ..... F04B 1/146 417/269
5,582,017 A 12/1996 Noji et al.
(Continued)

FOREIGN PATENT DOCUMENTS

CN 103808358 A 5/2014
CN 104079108 A 10/2014
(Continued)

OTHER PUBLICATIONS

International Search Report and Written Opinion from PCT/CN2019/097118 dated Oct. 24, 2019.
(Continued)

*Primary Examiner* — Christopher S Bobish
(74) *Attorney, Agent, or Firm* — Venable LLP; Michele V. Frank

(57) ABSTRACT

An electric drive compressor system (1) comprising: a reciprocating compressor (2) having temperature and pressure sensors (83, 84) for sensing a pressure and temperature of gas prior to compression by the compressor (1) and for sensing a pressure and temperature of gas after compression by the compressor (1); a motor (3) connected to the compressor (1) for driving the compressor (1); a cooling system (4) for cooling the motor (3); and a controller (5) for controlling the motor (3) in real time based on the temperature and pressure sensor readings of the gas prior to and after compression by the compressor (1). Features and advantages of the systems (1) as exemplified are as follows: lightweight and compact design; refrigerant circuit sealed from electric
(Continued)

motor for ease of maintenance and service; air cooled from unique fin and airflow passage design, with fan width pulse width modulation; intelligent control system with pressure and temperature sensors/transducers and software; separate compressor working assembly to ensure piston alignment and compression is not affected by heat distortion; separate outer housing and compressor crankcase to ensure leak free operation.

3 Claims, 19 Drawing Sheets

(51) Int. Cl.

| | |
|---|---|
| ***F04B 1/14*** | (2020.01) |
| ***F04B 1/12*** | (2020.01) |
| ***F04B 39/06*** | (2006.01) |
| ***F04B 49/06*** | (2006.01) |
| ***F04B 49/20*** | (2006.01) |

(52) U.S. Cl.
CPC ..... *F04B 49/06* (2013.01); *F04B 49/20* (2013.01); *F04B 53/08* (2013.01); *F04B 2205/00* (2013.01); *F04B 2205/05* (2013.01); *F04B 2205/10* (2013.01); *F04B 2205/11* (2013.01)

(56) References Cited

U.S. PATENT DOCUMENTS

| | | | | |
|---|---|---|---|---|
| 8,056,348 | B2 * | 11/2011 | Murakami | F25B 13/00 62/149 |
| 8,074,459 | B2 * | 12/2011 | Murakami | F25B 29/003 62/324.1 |
| 8,160,827 | B2 * | 4/2012 | Jayanth | F04B 49/00 702/63 |
| 8,335,657 | B2 * | 12/2012 | Jayanth | F04B 51/00 702/64 |
| 9,356,551 | B2 * | 5/2016 | Berry | H02P 29/60 |
| 9,863,680 | B2 * | 1/2018 | Nakajima | F25B 30/02 |
| 9,976,563 | B2 * | 5/2018 | Suzuki | F04D 27/005 |
| 10,473,127 | B2 * | 11/2019 | Ohshiro | E02F 9/226 |
| 10,876,526 | B2 * | 12/2020 | Graf | F04B 49/065 |
| 11,073,148 | B2 * | 7/2021 | Coeckelbergs | F04B 49/065 |
| 2003/0077179 | A1 * | 4/2003 | Collins | F04C 28/28 417/63 |
| 2004/0265144 | A1 * | 12/2004 | Fukanuma | F04B 35/002 417/269 |
| 2008/0289327 | A1 * | 11/2008 | Mintgen | F03C 1/007 60/477 |
| 2015/0247660 | A1 * | 9/2015 | Nakajima | F24F 11/30 62/225 |
| 2017/0356438 | A1 * | 12/2017 | Hughes | F04B 39/06 |
| 2018/0238329 | A1 * | 8/2018 | Kasahara | F04C 18/16 |
| 2019/0292975 | A1 * | 9/2019 | Hou | B60H 1/00014 |

FOREIGN PATENT DOCUMENTS

| | | | |
|---|---|---|---|
| CN | 104748905 | A | 7/2015 |
| CN | 205265422 | U | 5/2016 |
| CN | 106286259 | A | 1/2017 |
| CN | 206397740 | U | 8/2017 |
| CN | 107345825 | A | 11/2017 |
| CN | 207442637 | U | 6/2018 |
| JP | 2001132652 | A | 5/2001 |

OTHER PUBLICATIONS

The First Office Action from Chinese Application No. 201980048159.1 dated Jan. 6, 2022.

The Secnd Office Action from Chinese Application No. 2019980048159.1 dated May 16, 2022.

"Vehicle Maintenance and Repair Training Manual—Air Conditioner System (The first edition)", Nov. 1997, pp. 20-29.

"Vehicle Air-conditioning Device-Overhaul and Maintenance (the second edition)", Jan. 2016, Chapter 2, Refrigeration Compressor, pp. 45-46.

Xin Changping et al. "200 Cases of Use and Maintenance of Vehicle Air Conditioner": The first edition, Jun. 2000, pp. 288-290.

* cited by examiner

1D

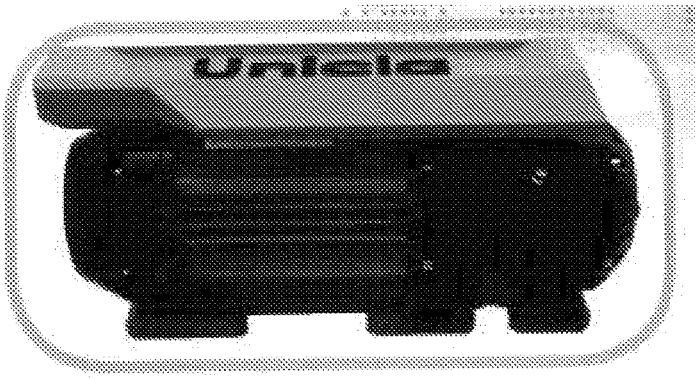

| Model | Condensing temp °C | Evaporating temp °C | | | UM |
|---|---|---|---|---|---|
| | | -5 | 0 | 5 | |
| SD150 | 38 | 5.85 | 6.62 | 8.37 | Cooling capacity |
| | | 2.15 | 2.31 | 2.52 | Power consumption |
| | 46 | 5.10 | 5.85 | 7.54 | Cooling capacity |
| | | 2.23 | 2.45 | 2.66 | Power consumption |
| | 54 | 4.52 | 5.21 | 6.71 | Cooling capacity |
| | | 2.25 | 2.45 | 2.66 | Power consumption |

R134a | RPM: 1800 r.p.m | Superheat: 0°C | Subcooling: 5°C

Details

- Capacity ..... 145 cc
- Output flow rate ..... 11.5 [m3/h]
- Weight ..... 19 Kg
- Dimension ..... 420 [L], 160 [W], 200 [H]
- Voltage range: ..... 24 VDC
  ..... 600 VDC
  ..... 750 VDC
  ..... 380-415 VAC 3PH

Figure 16

1E

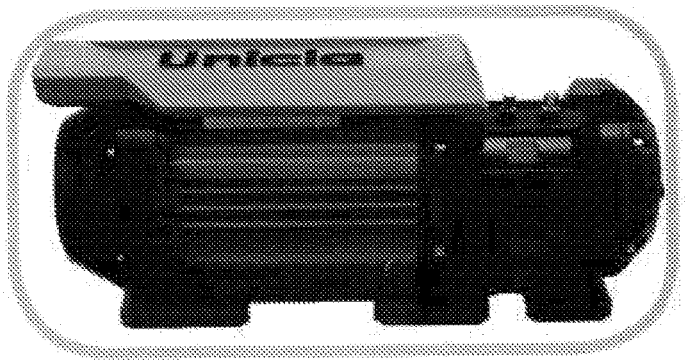

| Model | Condensing temp °C | Evaporating temp °C | | | UM |
|---|---|---|---|---|---|
| | | -5 | 0 | 5 | |
| SD200 | 38 | 7.82 | 9.15 | 11.50 | Cooling capacity |
| | | 3.80 | 4.00 | 4.22 | Power consumption |
| | 46 | 7.05 | 8.27 | 10.42 | Cooling capacity |
| | | 3.88 | 4.19 | 4.45 | Power consumption |
| | 54 | 6.25 | 7.32 | 9.28 | Cooling capacity |
| | | 3.87 | 4.22 | 4.56 | Power consumption |

R134a | RPM: 1800 r.p.m | Superheat: 0°C | Subcooling: 5°C

Details

- Capacity ..... 200.4 cc
- Output flow rate ..... 15.3 [m3/h]
- Weight ..... 24 Kg
- Dimension ..... 480 [L], 175 [W], 230 [H]
- Voltage range: ..... 600 VDC
  ..... 750 VDC
  ..... 380-415 VAC 3PH

Figure 17

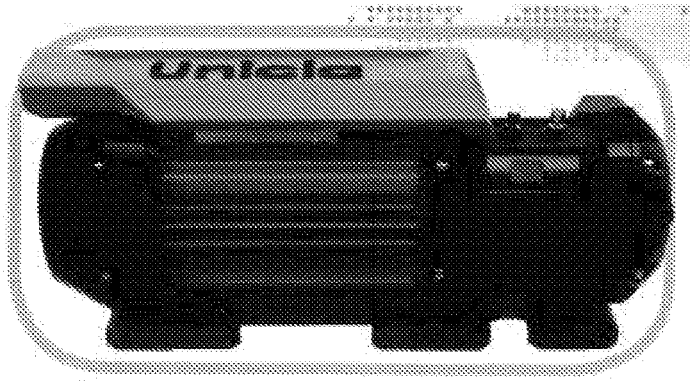

1F

| Model | Condensing temp. °C | Evaporating temp. °C | | | Info |
|---|---|---|---|---|---|
| | | -5 | 0 | 5 | |
| 60330 | 35 | 12.73 | 14.91 | 18.75 | Cooling capacity |
| | | 5.30 | 6.55 | 8.50 | Power consumption |
| | 45 | 11.48 | 13.48 | 16.98 | Cooling capacity |
| | | 5.58 | 6.85 | 8.35 | Power consumption |
| | 55 | 10.16 | 11.97 | 15.12 | Cooling capacity |
| | | 5.75 | 6.13 | 8.40 | Power consumption |

R134a | RPM: 1800 r.p.m | Superheat: 0°C | Subcooling: 5°C

Details

- Capacity ..... 330 cc
- Output flow rate ..... 25 (m3/h)
- Weight ..... 28 Kg
- Dimension ..... 400 (L), 210 (W), 240 (H)
- Voltage range: ..... 600 VDC
  ..... 750 VDC
  ..... 380-415 VAC 3PH

Figure 18

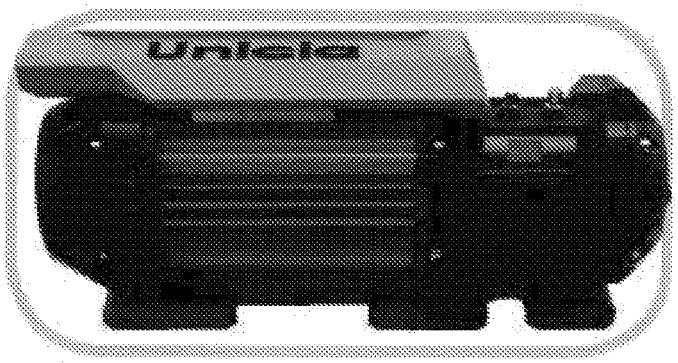

1G

| Model | Condensing temp. °C | Evaporating temp. °C | | | Info |
|---|---|---|---|---|---|
| | | -5 | 0 | 5 | |
| 60380 | 35 | 14.80 | 16.90 | 21.40 | Cooling capacity |
| | | 5.90 | 6.30 | 8.60 | Power consumption |
| | 45 | 13.17 | 15.40 | 19.30 | Cooling capacity |
| | | 6.12 | 6.60 | 7.00 | Power consumption |
| | 55 | 11.78 | 13.78 | 17.44 | Cooling capacity |
| | | 6.35 | 6.80 | 7.52 | Power consumption |

R134a | RPM: 1800 r.p.m | Superheat: 0°C | Subcooling: 5°C

Details

- Capacity ..... 380 cc
- Output flow rate ..... 29 (m3/h)
- Weight ..... 28 Kg
- Dimension ..... 400 (L), 210 (W), 240 (H)
- Voltage range: ..... 600 VDC
  ..... 750 VDC
  ..... 380-415 VAC 3PH

Figure 19

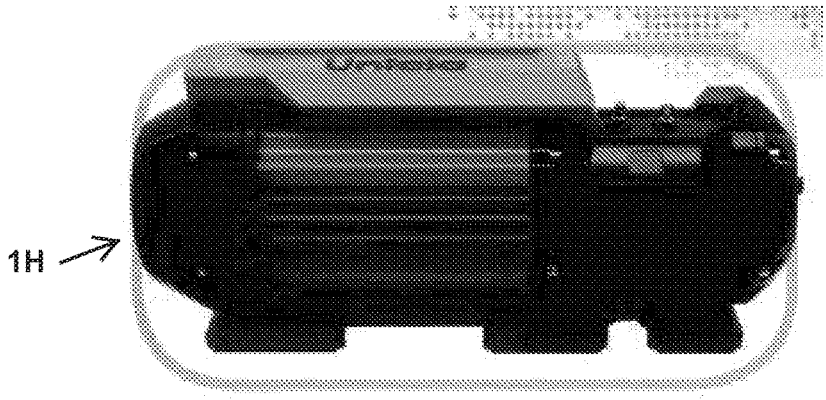

| Model | Condensing temp °C | Evaporating temp °C | | | HP |
|---|---|---|---|---|---|
| | | 0 | 5 | 10 | |
| ES440 | 55 | 19.36 | 22.67 | 28.70 | Cooling capacity |
| | | 8.40 | 8.90 | 9.60 | Power consumption |
| | 45 | 17.60 | 20.15 | 25.82 | Cooling capacity |
| | | 8.70 | 9.40 | 10.30 | Power consumption |
| | 35 | 15.71 | 18.40 | 23.29 | Cooling capacity |
| | | 9.00 | 9.80 | 10.70 | Power consumption |

R134a | RPM: 1800 r.p.m | Superheat: 0°C | Subcooling: 5°C

Details

- Capacity ..... 510 cc
- Output flow rate ..... 39 (m3/h)
- Weight ..... 57 Kg
- Dimension ..... 720 (L), 380 (W), 320 (H)
- Voltage range: ..... 600 VDC
  ..... 780 VDC
  ..... 380-415 VAC 3PH

Figure 20

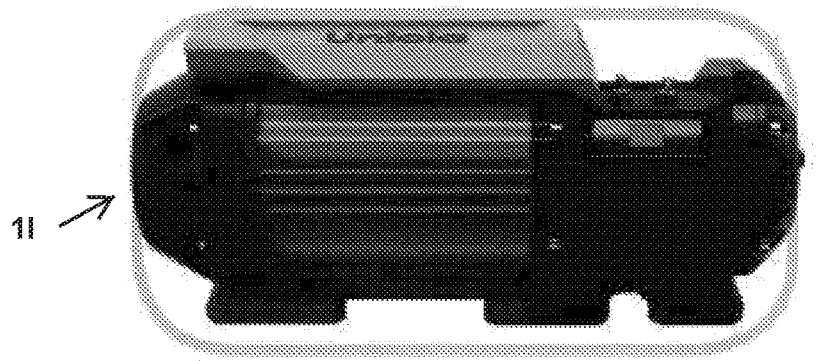

| Model | Condensing temp °C | Evaporating temp °C | | | HP |
|---|---|---|---|---|---|
| | | 0 | 5 | 10 | |
| ES380 | 55 | 23.34 | 26.61 | 34.32 | Cooling capacity |
| | | 9.50 | 10.00 | 10.70 | Power consumption |
| | 45 | 20.64 | 24.10 | 31.20 | Cooling capacity |
| | | 9.80 | 10.50 | 11.20 | Power consumption |
| | 35 | 18.79 | 22.00 | 27.85 | Cooling capacity |
| | | 10.10 | 11.00 | 11.80 | Power consumption |

R134a | RPM: 1800 r.p.m | Superheat: 0°C | Subcooling: 5°C

Details

- Capacity ..... 407 cc
- Output flow rate ..... 46.5 (m3/h)
- Weight ..... 57 Kg
- Dimension ..... 720 (L), 380 (W), 320 (H)
- Voltage range: ..... 600 VDC
  ..... 750 VDC
  ..... 380-415 VAC 3PH

Figure 21

ELECTRIC DRIVE COMPRESSOR SYSTEM

TECHNICAL FIELD

This invention relates to an electric drive compressor system and parts thereof. In one embodiment the invention concerns an electric drive compressor system comprising a compressor having temperature and pressure sensors, an electric motor for driving the compressor, a cooling system, and a controller for controlling the electric motor and cooling system based on sensor input. In another aspect the invention concerns a cooling system for a motor. In yet another aspect the invention concerns a compressor having temperature and pressure sensors.

BACKGROUND ART

Electric drive compressor systems are known. Disadvantages of known systems include that: they are not of lightweight and compact design; the refrigerant circuit is not usually sealed from the electric motor for ease of maintenance and service; motor cooling usually occurs by way of a fan that is coupled to a drive shaft of the motor; and, the compressors themselves do not have inbuilt pressure and temperature sensors/transducers.

SUMMARY OF THE INVENTION

It would be advantageous to minimize or overcome a disadvantage described above. Alternatively, it would be advantageous to provide the public with a useful or commercial choice.

According to a first aspect of the present invention, there is provided an electric drive compressor system comprising:

- a reciprocating compressor having temperature and pressure sensors for sensing a pressure and temperature of gas prior to compression by the compressor and for sensing a pressure and temperature of gas after compression by the compressor;
- a motor connected to the compressor for driving the compressor; and
- a controller for controlling the motor in real time based on the temperature and pressure sensor readings of the gas prior to and after compression by the compressor.

According to a second aspect of the present invention, there is provided an electric drive compressor system comprising:

- a reciprocating compressor having temperature and pressure sensors for sensing a pressure and temperature of gas prior to compression by the compressor and for sensing a pressure and temperature of gas after compression by the compressor;
- a motor connected to the compressor for driving the compressor;
- a cooling system for cooling the motor; and
- a controller for controlling in real time the motor and cooling system based on the temperature and pressure sensor readings of the gas prior to and after compression by the compressor.

According to a third aspect of the present invention, there is provided a reciprocating compressor having temperature and pressure sensors for sensing a pressure and temperature of gas prior to compression by the compressor and for sensing a pressure and temperature of gas after compression by the compressor.

According to a fourth aspect of the present invention, there is provided a cooling system for a motor, said cooling system comprising a fan connected to the motor and operated independently of the motor, optionally a fan control, and a housing cooling arrangement for cooling the motor.

According to a fifth aspect of the present invention, there is provided a method of operating an electric drive compressor system comprising:

- a reciprocating compressor having temperature and pressure sensors for sensing a pressure and temperature of gas prior to compression by the compressor and for sensing a pressure and temperature of gas after compression by the compressor;
- a motor connected to the compressor for driving the compressor; and
- a controller,
- wherein said method comprises the step of using the controller to control the speed of the electric motor in real time based on sensor input from said temperature and pressure sensors.

According to a sixth aspect of the present invention, there is provided a method of operating an electric drive compressor system of the second aspect, said method comprising the step of using the controller to control the speed of the electric motor in real time based on sensor input from said temperature and pressure sensors.

According to a seventh aspect of the present invention, there is provided an electric drive compressor system comprising a compressor and a motor connected to the compressor for driving the compressor in a manner such that the motor and compressor can be separated from each other without interrupting the refrigerant circuit of the compressor, wherein said compressor comprises a compressor drive shaft seal that extends around a drive shaft of the compressor and prevents leakage of refrigerant from the compressor, and wherein said motor comprises a motor drive shaft seal that extends around a drive shaft of the motor and prevents ingress of refrigerant.

DETAILED DESCRIPTION OF THE INVENTION

Features of the first to seventh aspects of the invention are described below. Where a feature refers to a feature of a system, context permitting, it could equally apply to a step of a method and vice-versa.

The electric drive compressor system is suitable for use in air conditioning and refrigeration systems. The electric drive compressor system can be used for mobile air-conditioning and refrigeration applications where electricity supply is a prime source of power.

The electric drive compressor system can be used for rail, mining, electric bus or industrial applications. Accordingly, the reciprocating compressor can be of any suitable size, shape and construction, and can be made of any suitable material or materials.

Any suitable type of reciprocating compressor can be used—eg. diaphragm, single acting or double acting. In some embodiments the compressor can be a swashplate compressor comprising a swashplate and piston arrangement. The compressor can comprise any suitable number of pistons, including 5, 6, 10, 12 or 14 pistons. The pistons can be axially opposed.

The compressor can have a single sensor for sensing both temperature and pressure of the gas prior to compression, or separate temperature and pressure sensors for separately sensing temperature or pressure of the gas prior to compression.

The compressor can have a single sensor for sensing both temperature and pressure of the gas after compression, or separate temperature and pressure sensors for separately sensing temperature or pressure of the gas after compression.

Any suitable type of pressure sensor can be used. The term 'pressure sensor' includes the following: pressure transducer, pressure transmitter, pressure sender, pressure indicator, piezometer and manometer.

The pressure sensor can be of an analogue type. If an analogue pressure sensor, then it can be a force collector type that would normally include a diaphragm, piston, bourdon tube or bellows to measure strain or deflection to an applied force over an area (pressure). Examples include: piezoresistive strain gauge, capacitive, electromagnetic, piezoelectric, strain-gauge, optical and potentiometric. Alternatively, it can be an electronic pressure sensor using other properties (such as density) to infer pressure of the fluid (e.g. gas or liquid). Examples include: resonant, thermal and ionisation.

Any suitable type of temperature sensor can be used. The term 'temperature sensor' includes the following: thermistor, thermocouple, resistance thermometer (also called resistance temperature detectors [RTDs]), silicon bandgap temperature sensor and thermometer.

Examples of thermistors include a negative temperature coefficient or NTC type, and positive temperature coefficient or PTC type.

Examples of thermocouples include: nickel-alloy thermocouples (type E, type J, type K, type M, type N, type T), platinum/rhodium-alloy thermocouples (type B, type R, type S); tungsten/rhenium-alloy thermocouples (type C, type D, type G); other types (chromel-gold/iron-alloy thermocouples, type P (noble-metal alloy), platinum/molybdenum-alloy thermocouples, iridium/rhodium alloy thermocouples, pure noble-metal thermocouples Au—Pt, Pt—Pd, skutterudite thermocouples).

In some embodiments, the compressor has a single sensor for sensing both temperature and pressure of the gas before compression, and a single sensor for sensing both temperature and pressure of the gas after compression.

The sensor can comprise at least one sensing region and a sensor body extending from the sensing region. The body can be in the form of a fitting for a housing of the compressor. The body can extend through a housing of the compressor. The body can be threaded and extend through a threaded socket of the compressor housing. The sensor can comprise a sensor lead wire or contact, for connection with the controller. The temperature and pressure sensor can connect straight into a printed circuit board of the controller. The at least one sensing region can comprise, in some embodiments, a thermistor sensor located at a lower part of the sensor and a pressure plate located at another part of the sensor, preferably above the thermistor. The thermistor sensor can be surrounded by a sensor guard.

Each sensor can have at least one sensing region for sensing the temperature or pressure of the gas. The at least one sensing region can be located at any suitable location or locations of the compressor, such as: in, at or adjacent a suction, intake or discharge line; in, at or adjacent a suction, intake or discharge port; in, at or adjacent a valve plate compartment; in, at or adjacent a high pressure gas zone; in, at or adjacent a low pressure gas zone; or in, at or adjacent a gas manifold of the compressor.

The compressor can have a gas suction or intake line and a discharge line. Each sensor can have at least one sensing region for sensing the temperature or pressure of the gas within the gas suction or intake line or discharge line.

The compressor can have a gas suction port or intake port and a discharge port. Each sensor can have at least one sensing region for sensing the temperature or pressure of the gas within the suction port/intake port or discharge port.

The compressor can have a valve plate compartment having a high pressure zone or sub-compartment and a low pressure zone or sub-compartment. Each sensor can have at least one sensing region for sensing the temperature or pressure of the gas located within the valve plate compartment. For gas before compression, the at least one sensing region can be located within the low pressure zone or sub-compartment of the valve plate compartment. For gas after compression, the at least one sensing region can be located within the high pressure zone or sub-compartment of the valve plate compartment.

The compressor can have a refrigerant circuit. Each sensor can have at least one sensing region for sensing the temperature or pressure of the gas within different pressure zones of the refrigerant circuit.

The compressor can comprise a compressor housing. The housing can comprise two or more connectable pieces. The compressor housing can be made of aluminium.

The compressor can have a front end and a rear end. The compressor housing can comprise a front wall or front end and a rear wall or rear end. The compressor housing can comprise a main cylindrical housing having a cylindrical sidewall and front wall or front end, as well as a rear wall or rear end that is fastened to the main housing by way of mechanical fasteners. The compressor housing can comprise feet. The feet can be attached to the main housing by way of mechanical fasteners.

The compressor can comprise a valve plate compartment located between a wall of the compressor housing and a discharge valve plate. The valve plate compartment can have two sub-compartments, one of which has gas under high pressure and is in direct fluid communication with the discharge port and one of which has gas under low pressure and is in direct fluid communication with the intake/suction port.

The compressor can comprise one or more of the following: a discharge valve plate; a first gasket; a first suction valve plate; a first cylinder block; piston assemblies (eg. 5 piston assemblies); a first thrust bearing; shoe discs; balls; a swashplate; a compressor drive shaft; a locking pin; a second thrust bearing; a second cylinder block; a needle bearing; a second suction valve plate; a second gasket; and, a further valve plate.

The compressor can be substantially as described in Japanese patent publication number 60-104783, the entire contents of which are incorporated herein by way of cross-reference.

The compressor housing can comprise various openings or sockets for other compressor components such as the pressure and temperature sensors, sight glasses, an oil return port, an oil drain plug, a relief valve and plugs for the gas intake and discharge ports.

The compressor can comprise a working assembly comprising the valve plates, gaskets, cylinder blocks, piston assemblies, swashplate and compressor shaft etc. The compressor can comprise a valve plate compartment located between a front wall or front end of the main housing and the discharge valve plate/end of the working assembly. The valve plate compartment can have two sub-compartments, one of which is under high pressure and is in direct fluid communication with the discharge port and one of which is under low pressure and is in correct fluid communication with the intake/suction port.

The dual pressure and temperature sensors are, in a preferred embodiment, model number TEM00875 as manufactured by Sensata Technologies. This sensor type has a thermistor sensor located at a lower end of the sensor and a pressure plate located at another part of the sensor, preferable above the thermistor sensor. The thermistor sensor is surrounded by a sensor guard.

The gas can be a refrigerant gas, although other gas types are envisaged. The gas can be flammable or not.

The swashplate can be an elliptical disk mounted at an angle to the compressor shaft. The compressor shaft can extend through the thrust bearings, each of which can engage a wall of a cylinder block. One end of the compressor shaft can be splined or keyed and can extend through a front wall or end of the compressor housing in the sealing manner, for connection to an end of a drive shaft of the motor. Another end of the compressor shaft can extend within a needle bearing, which bearing locates within a central bore of a cylinder block.

Each piston assembly can include a pair of axially opposed pistons configured to slide relative to a bore of a cylinder block. A head of each piston can have a sealing ring. Another end of each piston can have a socket for receiving a ball. An end of each piston can engage the swashplate by way of a shoe disc and a ball that rides within a socket of the shoe disc and the socket of the piston. The shoe disc (slipper disc) can slide on the swashplate. As the compressor shaft rotates the swashplate, the pistons are caused to move in a reciprocating manner parallel with the compressor shaft within the cylindrical bores. This reciprocating motion can suck gas through the intake/suction port and further through the low pressure sub-chamber of the valve compartment and can discharge compressed gas through the discharge port via the high pressure sub-chamber of the valve compartment.

The compressor housing can be fluid-tight and such that no gas is able to escape from the compressor to the environment, including to the motor.

The compressor housing can have cooling formations, such as those described elsewhere in this specification.

The compressor drive shaft is scalable in length to increase or decrease torque.

Any suitable type of motor can be used. A motor drive shaft of the motor can be connected to the compressor drive shaft in any suitable way.

The motor is preferably an electric motor. The motor can be self commutated or externally commutated. Examples of suitable electric motors are listed in Table 1 below.

TABLE 1

| Major categories by type of motor commutation | | | | |
|---|---|---|---|---|
| Major Categories by Type of Commutation | | | | |
| Self-Commutated | | | Externally Commutated | |
| Mechanical-Commutator Motors | | Electronic-Commutator (EC) Motors | Asynchronous Machines | Synchronous Machines |
| AC | DC | AC | AC | |
| Universal motor (AC commutator series motor or AC/DC motor) Repulsion motor | Electrically excited DC motor: Separately excited Series Shunt Compound PM DC motor | With PM rotor: BLDC motor With ferromagnetic rotor: SRM | Three-phase motors: SCIM WRIM AC motors: Capacitor Resistance Split Shaded-pole | Three-phase motors: WRSM PMSM or BLAC motor IPMSM SPMSM Hybrid AC motors: Permanent-split capacitor- Hysteresis Stepper SyRM SyRM-PM hybrid |
| Simple electronics | Rectifier, linear transistor(s) or DC chopper | More elaborate electronics | Most elaborate electronics (VFD), when provided | |

Preferably the electric motor is a brushless DC motor. The brushless DC motor can be of any suitable design.

The motor can have a front end and a rear end.

The motor can comprise a motor housing. The motor housing can be made of aluminium.

The motor housing can comprise a compressor-mounting end at one end of the housing and a fan-mounting end at an opposing end of the housing. The motor housing can comprise a front end, front wall or front cap. The motor housing can comprise a rear end, rear wall or a rear cap. The motor housing can comprise two or more connectable pieces.

The motor housing can comprise a main cylindrical housing having a cylindrical sidewall and front wall or front end, as well as a rear wall or rear end. One or more of these ends can be fastened to the main housing by way of mechanical fasteners. The motor housing can comprise feet. The feet can be attached to the main housing by way of mechanical fasteners.

The motor can comprise a motor drive shaft. The motor can comprise a rotor. The motor can comprise a stator. The motor can comprise bearings for supporting the drive shaft. The motor can comprise lead wires/contacts.

The motor drive shaft can be hollow cylinder and can have a front end and a rear end. The front end can be supported within a ball bearing at the front end of the motor housing. The rear end the hollow cylinder can extend around a ball bearing at the rear end of the motor housing. The motor drive shaft can include a splined/keyed socket located within the hollow cylinder, at the front end of the hollow cylinder. The splined/keyed socket can be sized to firmly engage/friction fit with the splined/keyed end of the compressor drive shaft.

The motor housing can comprise a main cylindrical housing having a cylindrical sidewall, a front cap/front end wall, a rear cap/rear end wall, and feet. Both caps/end walls can be fastened to the main housing by way of mechanical fasteners.

The front end wall of the motor housing can comprise a recess that supports a ball bearing. The rear end wall of the motor housing can comprise a boss about which extends a ball bearing. The front wall of the motor housing can comprise a central opening or boss that receives the splined/keyed end of the compressor drive shaft. The rear wall of the motor housing can comprise a recess, groove or pocket adapted to mount a fan motor of the cooling system.

Motor lead wires/contacts can extend from the controller to the stator via a rear end wall of the motor housing.

The motor housing can be detachably connected to the compressor housing in any suitable way (eg. for maintenance and cleaning). For example, mechanical fasteners (eg. nuts and bolts) can be secured through mounting points or eyelets of the compressor main housing and mounting points, passages or eyelets of the motor housing.

The motor and compressor can be separated from each other without interrupting the refrigerant circuit of the compressor. This can be achieved by way of the compressor shaft seal preventing the leakage of gas from the compressor. In the case of flammable gas/refrigerant, the motor can further comprising a motor shaft seal extending about a drive shaft of the motor, in the event that the compressor shaft seal should leak. (This may not be required in the case of a non-flammable gas.)

The motor can comprise a motor control. The motor control can be of any suitable construction. The motor control can comprise a motor temperature sensor. The motor control can comprise a motor position/Hall-effect sensor for monitoring the position/speed of the motor. The motor control can be part of the controller, as described below.

The motor temperature sensor can be of any suitable construction. The motor temperature sensor can be part of the controller, as described below. The motor temperature sensor can be located on the stator housing.

The motor position/Hall-effect sensor can be of any suitable construction. The motor position/hall sensor can be part of the controller, as described below. The motor position/Hall-effect sensor can be located on a rear cap or wall of a motor housing.

Any suitable type of cooling system can be used. The cooling system can comprise a fan operated independently of the motor, optionally a fan control, and a housing cooling arrangement.

The fan can be mounted or connected to any suitable region or part of the motor housing. For example, the fan can be mounted to a rear wall or rear end or within a pocket or recess of a rear wall or rear end of the motor housing.

The fan can be of any suitable construction and can be made of any suitable material or materials. The fan can comprise a mounting base plate or bracket, a motor having a drive shaft, an impeller and a fan lead wire/contact.

The mounting base plate can be mounted to or within the rear wall of the motor housing, eg. by way of mechanical fasteners. For example, the mounting base plate can be mounted within a recess or pocket in the rear wall of the motor housing. The motor can be situated between the base and the impeller. The drive shaft of the motor can engage a central opening in a hub of the impeller. The impeller can spin within an annular groove of the motor's rear wall.

The housing cooling arrangement can comprise cooling formations associated with the motor housing. The cooling formations can be of any suitable size, shape and construction. In some embodiments the cooling formations can comprise airflow passages. The airflow passages can extend from or along the motor housing's exterior or periphery. The airflow passages can extend substantially parallel with the motor drive shaft, through which cooling air from the fan can flow. The airflow passages can extend from one end of the motor housing to the other end of the motor housing. The airflow passages can extend substantially parallel with one another about some, most or all of the periphery of the motor housing.

In some embodiments the airflow passages are in the form of radially extending fins extending from or along a periphery of the motor housing, whereby cooling air flows between adjacent fins. For example, radially extending fins may extend from the motor housing towards a housing of the controller, and cooling air can pass between adjacent fins between the motor housing and controller housing. In some embodiments the fins extend substantially parallel with the motor drive shaft from one end of the motor housing to the other.

In some embodiments the airflow passages are in the form of enclosed elongate channels, passages or cells extending from or along a periphery of the motor housing, whereby cooling air flows with an air inlet of a said channel, passage or cell at or adjacent one end of the motor housing and exits a said channel, passage or cell at or adjacent another end of the motor housing.

In some embodiments, when viewed on end, the motor housing's exterior/perimeter can be similar to a honeycomb structure with airflow passages resembling cells of a honeycomb.

The housing cooling arrangement can comprise cooling formations associated with the compressor housing. The cooling formations can be of any suitable size, shape and construction. In some embodiments the cooling formations can comprise airflow passages. The airflow passages can extend from or along the compressor housing's exterior or periphery. The airflow passages can extend substantially parallel with the compressor drive shaft, through which cooling air can flow. The airflow passages can extend from one end of the compressor housing to the other end of the compressor housing. The airflow passages can extend substantially parallel with one another about some, most or all of the periphery of the compressor housing.

In some embodiments the airflow passages are in the form of radially extending fins extending from or along a periphery of the compressor housing, whereby cooling air flows between adjacent fins. In some embodiments the fins extend substantially parallel with the compressor drive shaft from one end of the compressor housing to the other. In some embodiments the airflow passages are in the form of enclosed elongate channels, passages or cells extending from or along a periphery of the compressor housing, whereby cooling air flows with an air inlet of a said channel, passage or cell at or adjacent one end of the compressor housing and exits a said channel, passage or cell at or adjacent another end of the compressor housing.

The housing cooling arrangement can comprise cooling formations associated with the controller housing. The cooling formations can be of any suitable size, shape and construction. In some embodiments the cooling formations can comprise airflow passages. The airflow passages can extend from or along the controller housing's exterior or periphery. The airflow passages can extend substantially parallel with the motor drive shaft, through which cooling air from the fan can flow. The airflow passages can extend from one end of the controller housing to the other end of the controller housing. The airflow passages can extend as fins substantially parallel with one another. The fins can extend between some of the airflow passages/fins of the motor housing.

Blades of the impeller can be orientated so as to force air into the air passages. The fan lead wire/contact can extend through the rear end wall of the motor housing.

The housing cooling arrangement can comprise fan cover that extends over the impeller. The fan cover can be connected to the rear end wall or rear end of the motor housing, eg. by way of mechanical fasteners.

The fan cover can comprise one or more inlets. The one or more inlets can be in the form of an air intake grill, chute or port for drawing in air from outside the fan cover.

The fan cover can comprise one or more baffles located between the one or more inlets and fan motor, for preventing water that has entered the fan cover from reaching electronic componentry of the fan or motor.

The fan cover can comprise one or more air discharge passages or outlets for directing air into the airflow passages associated with the motor housing and optionally airflow passages associated with the compressor housing. The one or more air discharge passages or outlets can be in the form of a passage, chute or port.

The fan cover can comprise one or more air discharge guides for directing air into the airflow passages associated with the motor housing and optionally airflow passages associated with the compressor housing. The air discharge guides can be of any suitable size, shape and construction. In this way, the motor and optionally the compressor can be cooled by that air. Also, electronics of the controller can be cooled by airflow between the airflow passages and the controller housing. No compressor refrigerant need be sacrificed by passing it through the motor housing, as would be done conventionally.

The fan control can be of any suitable construction. The fan control can be part of the controller, as described below.

Any suitable type of controller can be used.

The controller can comprise a controller housing. The controller housing can be of any suitable size, shape and construction, and can be made of any suitable material or materials. The controller housing can be made of metal alloy. The controller housing can comprise a front end and a rear end. The controller housing can comprise a bottom wall and a top wall.

Electronics of the controller located above the bottom wall can be cooled by airflow between the controller housing and motor housing.

The controller housing can comprise two or more connectable pieces. The controller can be secured to the motor housing. For example, the controller housing can be secured to the motor housing by way of mechanical fasteners. The bottom wall of the controller housing can comprise one or more side mounts for receiving mechanical fasteners.

The bottom wall of the controller housing or the cooling arrangement can have one or more downwardly extending fins that extend between the airflow passages of the motor housing/cooling arrangement.

The controller housing can comprise at least one opening through which extends a sensor lead wire or contact in a sealed manner. The opening can be located in the bottom wall or sidewall of the controller housing.

The controller housing can comprise at least one opening through which extends a fan lead wire or contact in a substantially sealed manner. The opening can be located in a bottom wall or sidewall of the controller housing.

The controller housing can comprise at least one opening through which extends a motor lead wire or contact in a substantially sealed manner. The opening can be located in a bottom wall or sidewall of the controller housing.

The controller can comprise logic circuitry such as a PLC, microprocessor or microcontroller. The logic circuitry can be contained within the controller housing. The controller may be configured logic in the form of reprogrammable software or hardcoded software executed by the microcontroller. Alternatively, the controller may be configured with hardcoded logic in the form of an application specific integrated circuit, or programmable logic in the form of a field programmable gate array. Hardcoded logic may be incorporated in conjunction with a microcontroller or in place of a microcontroller.

For the sake of simplicity, we will refer to a 'microcontroller' below, but it is to be understood that it need not be a microcontroller but could be alternative features, as described above.

The controller may be reprogrammable by a user, or by a connected controller, and be suitably configured for any design and operating conditions.

The controller can comprise contacts or electrical sockets for the leads/contacts of the temperature and pressure sensors. Electrical contacts or sockets can be located at or adjacent a bottom wall or sidewall of the controller housing.

The controller can comprise a temperature sensor for sensing the temperature of the motor. The motor temperature sensor may output temperature information digitally for input into the controller. Alternatively, the motor temperature sensor may output temperature information in an analog format, in which case the temperature signal may be converted to digital format via an analog to digital converter, prior to input into the controller.

The controller can comprise contacts or electrical sockets for the motor lead wires or contacts.

The controller can comprise contacts or electrical sockets for the fan lead wire or contact.

The controller can comprise a power converter, such as a DC to DC converter.

The controller can comprise a transceiver module, such as a 3G or 4G transceiver module. A transceiver's antenna can be made of polycarbonate.

The controller can comprise a CAN/LIN communication interface or bus.

The controller can comprise, for example, power amplifiers, power level shifters, transistors or other circuitry or components.

The controller can be connectable to a power supply.

The controller can comprise a microcontroller electrically connected to the temperature and pressure sensors, for receiving input from those sensors.

The microcontroller can be electrically connected to a temperature sensor associated with the motor for receiving input from that sensor.

The microcontroller can be electrically connected to speed/position/Hall-effect sensors associated with the motor for receiving input from those sensors.

The microcontroller can comprise a fan control for managing the rotational speed of the fan. The fan control can utilise pulse-width modulation to communicate control signals to the fan.

Alternatively, the fan controller can use other digital or analog signalling methods to communicate control signals to the fan.

The microcontroller can comprise a motor speed control for managing the rotational speed of the motor. The motor speed control can comprise power amplifiers and transistors, for example, in the form of high and low side gate drivers and MOSFET switches.

The controller can comprise a power source or can be connected to VDC (eg. 600 VDC) and can comprise a DC to DC converter. The DC to DC converter can be connected to high side gate drivers and microcontroller. The 600 VDC can be connected to MOSFET switches.

The controller can comprise a wireless transceiver module for both transmitting and receiving data wirelessly between the microcontroller and a remote device, such as a receiver, server, PC, website or user interface.

The controller can comprise a CAN/LIN communication interface or bus, enabling communication between the microcontroller and other applications, devices or user interface.

The electric drive compressor system or controller can enhance compressor performance during normal system operation and can provide protection in unfavourable conditions or from a specific system fault.

The electric drive compressor system or controller can comprise controller software.

The electric drive compressor system or controller can comprise a user interface for setting parameters and to allow real time/live time viewing of compressor parameters and operation. The electric drive compressor system or controller can comprise an Application Programmable Interface for setting parameters and to allow real time/live time viewing of compressor parameters and operation.

The electric drive compressor system or controller can utilise logic control to protect the compressor from excessive pressure and thermal loads. The electric drive compressor system or controller can be customised across a range of discharge and suction side pressures, and thermal parameters. In addition to baseline parameter settings, the controller software can be pre-programmed to the type of refrigerant, compressor size and system designed to enhance compressor performance and protection specific to the characteristics of the relative gas/refrigerant.

The system or controller can utilise software designed to permit configuration of the electric drive compressor system for any suitable design and operating condition. Through the software or logic of the controller, safety and operational parameters can be set for the suction and discharge pressures, excessive compressor body temperatures, excessive suction line and discharge superheat. This functionality gives an end user the ability to tailor or fine tune the controller and the overall system.

Connection to the controller can be made via CAN bus (Controller Area Network), LIN bus (Local Interconnect Network) connections to allow real time/live time viewing, or logging, of compressor parameters and operation.

The wireless transceiver module can provide online connection and data transmission to a receiver, server, PC, smartphone, web interface or other web portal as required.

The controller can monitor pressure and temperature data of the gas entering and exiting the compressor, and communicate with the motor, to configure how fast the motor should spin.

Controlling of the motor, including on/off and speed functions can be done by an external entity via the CAN or LIN connection and via the microcontroller.

The temperature and pressure sensors can be used to simultaneously measure the pressure and temperature of the gas prior to compression and after compression. Measured gas temperature and gas pressure data can be communicated to the controller and a series of predefined commands can adjust the compressor to work at its best, or preferred, performance.

The controller or logic circuit can communicate either through a wired connection or wirelessly (e.g., Wi-Fi (WLAN) communication, Satellite communication, RF communication, infrared communication, or Bluetooth™) via the wireless transceiver, with a standalone computer, a computer network, a website interface, smart phone or other electronic device.

The controller can have a data logging or other data recording function, or communicate with a receiver having a data logging or other data recording function. The receiver can have a CPU. The receiver can have memory. The receiver can have a display screen. The receiver can have a user-friendly interface. The receiver can have a printing function.

Operating parameters to be used by the controller may be configured by way of a user interface in wireless communication with the controller via the 3G or 4G transceiver module. The controller may receive an indication of the refrigerant/gas pressure via the temperature/pressure sensors, then a control signal can be sent to start the motor. The motor's temperature can be monitored via the temperature sensor.

The controller can determine whether the temperature of the motor is within accepted operating range, and can send a signal to shut down the motor if the temperature is outside of accepted operating range. Similarly, the controller can determine whether the voltage usage of the motor is within accepted operating range, and can send a signal to shut down the motor if the voltage is outside of accepted operating range. The controller can determine whether the revs per minute (RPM) of the motor is within accepted operating range, and can send a signal to shut down the motor if the RPM is outside of accepted operating range.

The speed of the motor can be modified via the MOSFET switches as required. The controller can use the operating parameters of the motor to calculate motor efficiency. Motor efficiency information can be logged and communicated to an external server.

The compressor can be started by a start signal produced by the controller or via an external source. The temperature and pressure of the suction line and discharge line can be monitored by the temperature/pressure sensors. The temperature/pressure sensors can communicate the temperature and pressure information to the controller. The controller can determine whether the temperature of the gas in the suction line is within accepted operating range, and can send a signal to shut down the motor if the temperature is outside of accepted operating range. Similarly, the controller can determine whether the temperature of the gas in the discharge line is within accepted operating range, and can send a signal to shut down the motor if the temperature is outside of accepted operating range.

The controller can determine whether the pressure of the gas in the suction line is within accepted operating range, and can send a signal to shut down the motor if the pressure is outside of accepted operating range. Similarly, the controller can determine whether the pressure of the gas in the discharge line is within accepted operating range, and can send a signal to shut down the motor if the pressure is outside of accepted operating range.

The controller can modify the motor's speed as required to ensure optimal operating conditions.

In the event that the controller determines that the pressure or the temperature of the gas within the suction line or the discharge line is outside accepted operating range, the controller may log an event occurrence. In the event that the controller determines that one or more of the motor's operating parameters are outside accepted operating range, the controller may log an event occurrence.

The controller may be configured to send a notification signal to an external server under certain conditions, such condition may be the occurrence of a certain number of logged events within a set time period.

The controller may shut down the electric drive compressor system after notifying an external server of one or more event occurrences. The controller may log the shutdown of the electric drive compressor system and may log associated parameters of the event occurrence.

The method can comprise the step of connecting the electric drive compressor system into a refrigerant circuit containing refrigerant.

The method can comprise the step of connecting hoses to the intake/suction and discharge ports of the compressor.

The method can comprise the step of conducting compressor oil checks, checking leaks at the compressor connections and other connections.

The method can comprise the step of evacuating air from the refrigerant circuit using a vacuum pump.

The method can comprise a charging step whereby the system is filled with a final refrigerant via an approved point in the refrigerant circuit, in accordance with manufacturer recommendations and following ISO and ASHRAE.

The method can comprise the step of connecting the controller to a remote receiver such as a server, smartphone, smart device, tablet, user interface, PC, web portal, laptop or Android system using a wireless connection or wired connection (eg. Bluetooth, LIN, CAN or USB connection).

The method can comprise the step of running software on the remote receiver.

The method can comprise the step of utilising a user interface.

The method can comprise the step of entering system parameters and checking and/or changing pressure and temperature settings to ensure that they are in line with manufacturer recommendations for the refrigerant circuit that the electric drive compressor system is connected to.

The method can comprise the step of checking the current refrigerant pressure level to ensure that the system is ready to commission/switch on.

The method comprises the step of monitoring pressure and temperature data at the same time, in real-time.

The method can comprise the step of letting the controller make a decision whether to turn the motor on or off, or to run the motor at a different speed. In turn, this will affect the compressor's operation.

The method can comprise the step of taking a temperature reading of the motor and letting the controller make a decision whether or not to cool the motor.

The method can comprise the step of the fan control receiving pressure and temperature data from the intake/suction and discharge ports of the compressor at the same time, and the controller making a decision based on that data whether to turn the cooling fan on or off, or to run the fan at a specific speed.

The motor control and fan control steps can be carried out simultaneously in real-time based on temperature and pressure data coming from the sensors of the compressor.

The method can employ the following steps regarding management rules:

Discharge side: —If the discharge line total vapour pressure exceeds the limit, then: 1. turn on the cooling fan before the motor gets hot; 2. slow the motor's speed; or, 3. turn off the motor for a period of time. If a superheat temperature exceeding the limit is detected at the discharge line, then: 1. turn on the cooling fan before the motor gets hot; 2. slow the motor's speed; or, 3. turn off the motor for a period of time.

Firmware software: —If three faults are detected within 20 minutes of each other, then the motor is turned off as a failsafe of the system.

Suction side: —If low pressure is detected on the suction side, then the controller decides whether it is refrigerant related or something else. If low pressure is indicative of low refrigerant, then the system is turned off.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF FIGURES

Various embodiments of the invention will be described with reference to the following figures.

FIGS. 16-21 give details of various electric drive compressor systems, according to other embodiments of the present invention.

DESCRIPTION OF EMBODIMENTS

Figure 1:
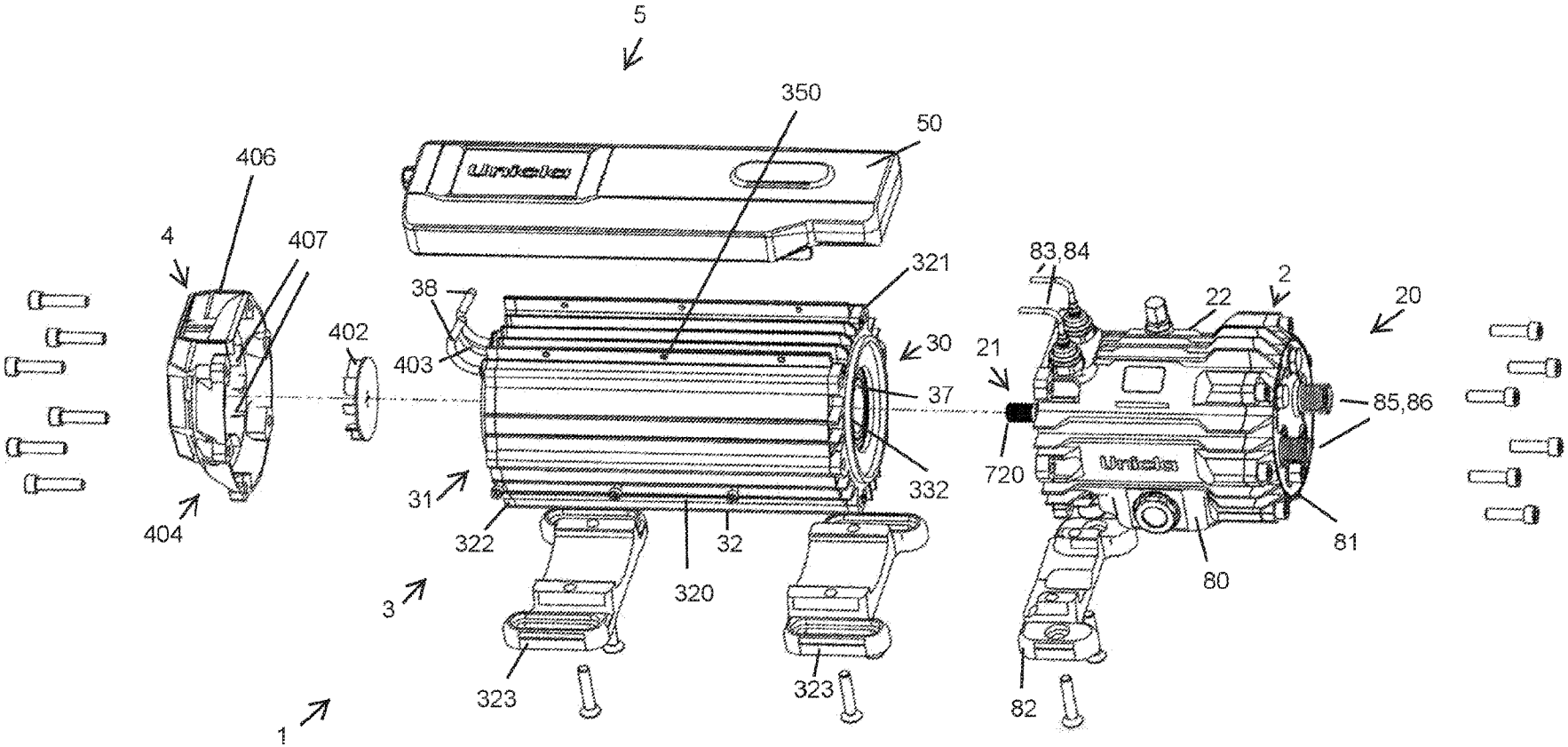
FIG. 1 is a partially exploded view of an electric drive compressor system that includes a compressor, motor, cooling system and controller, according to an embodiment of the present invention.
Figure 2:
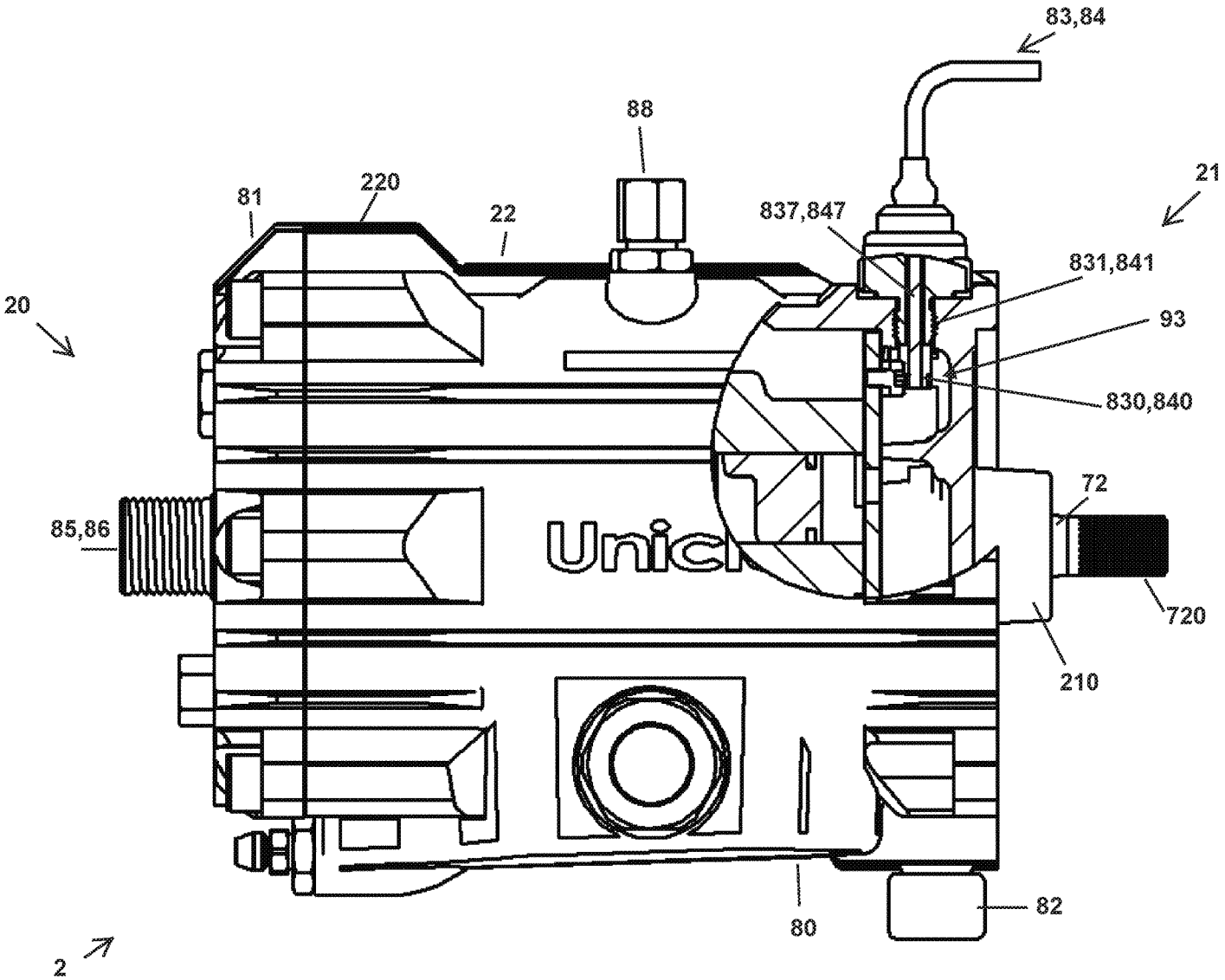
FIG. 2 is a side elevation view and part detailed view of the compressor shown in FIG. 1.
Figure 3:
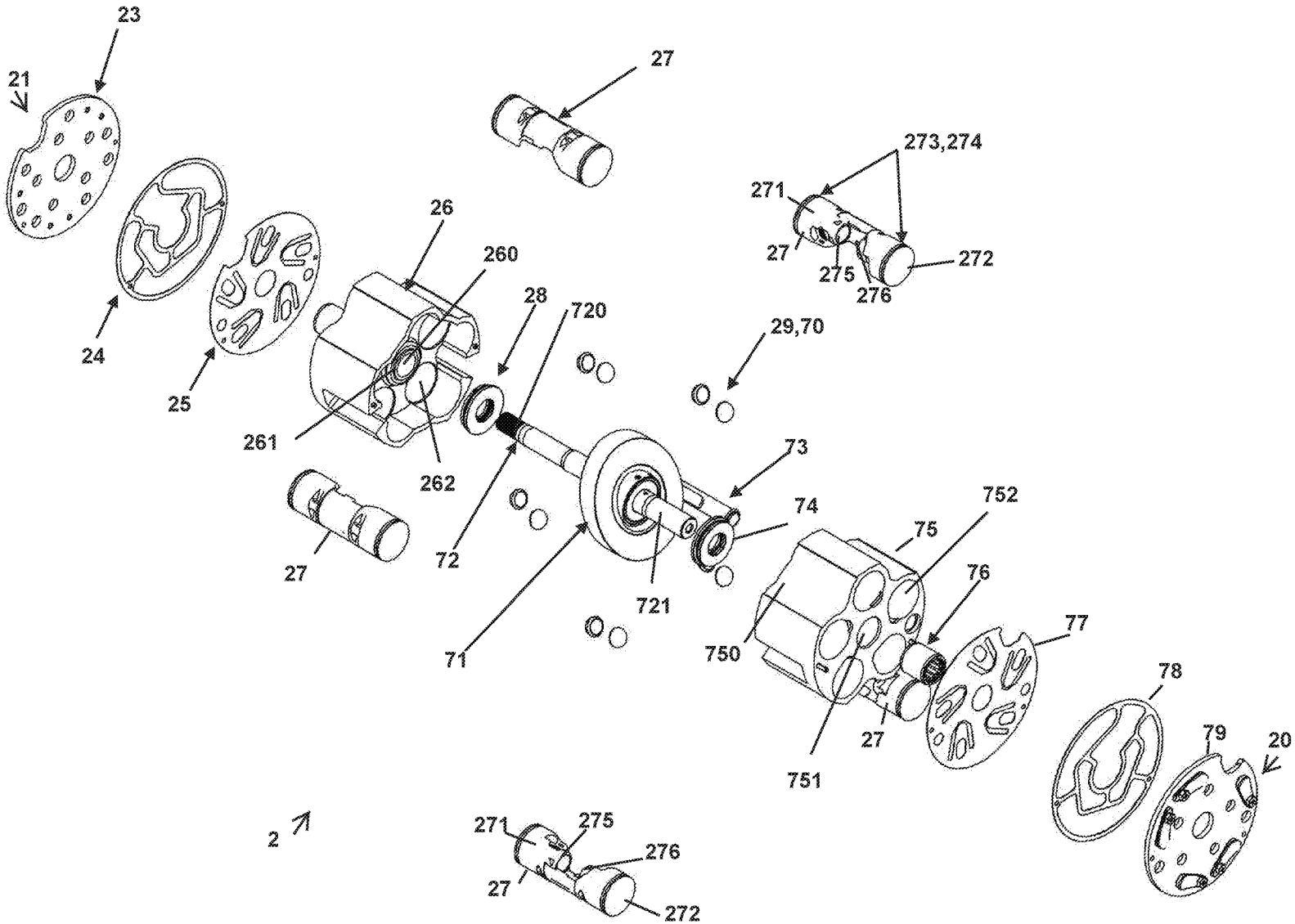
FIG. 3 is an exploded view of part of the compressor shown in FIG. 2.
Figure 4:
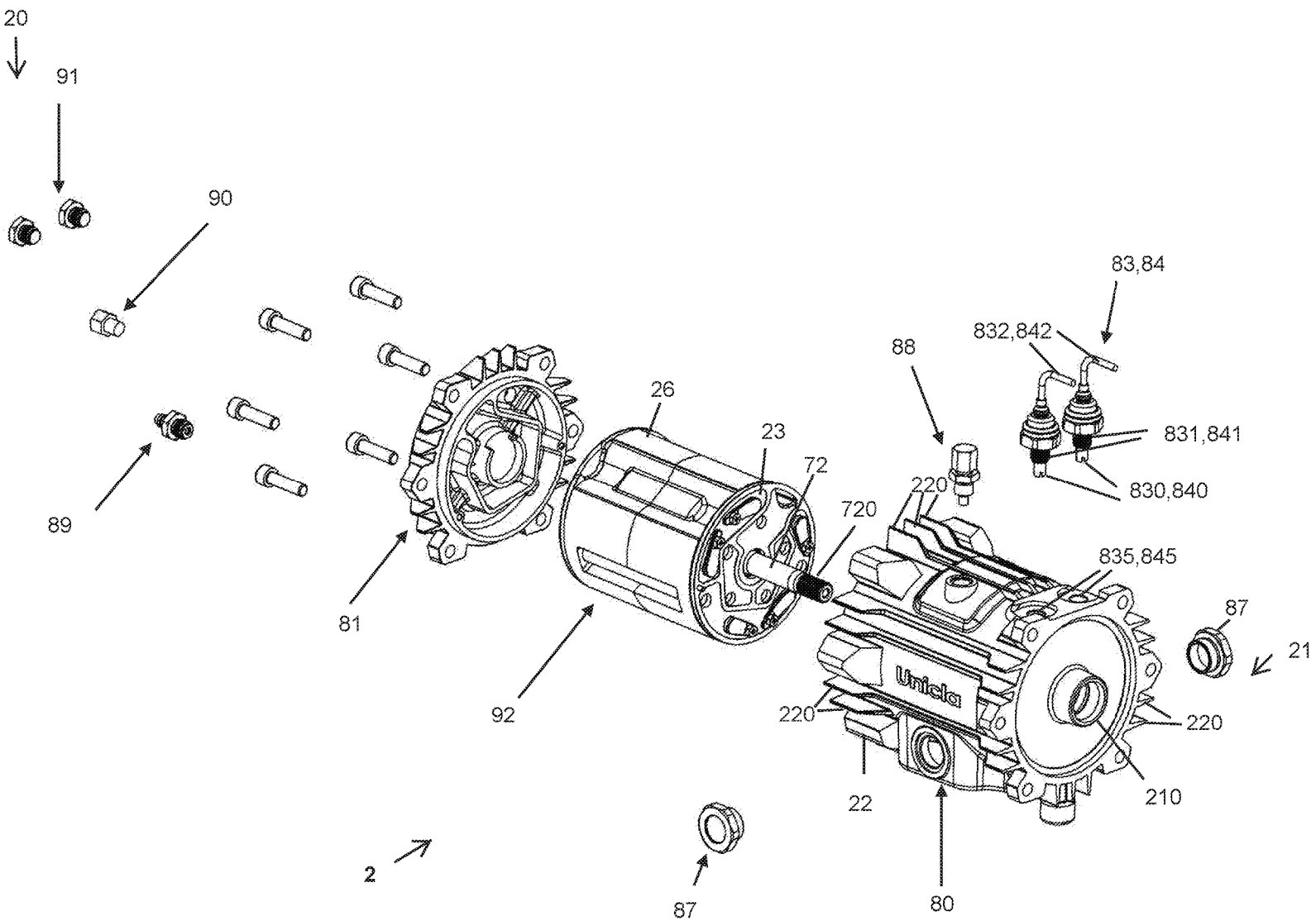
FIG. 4 is a partial exploded view of the compressor and cooling system shown in FIG. 2.
Figure 5:
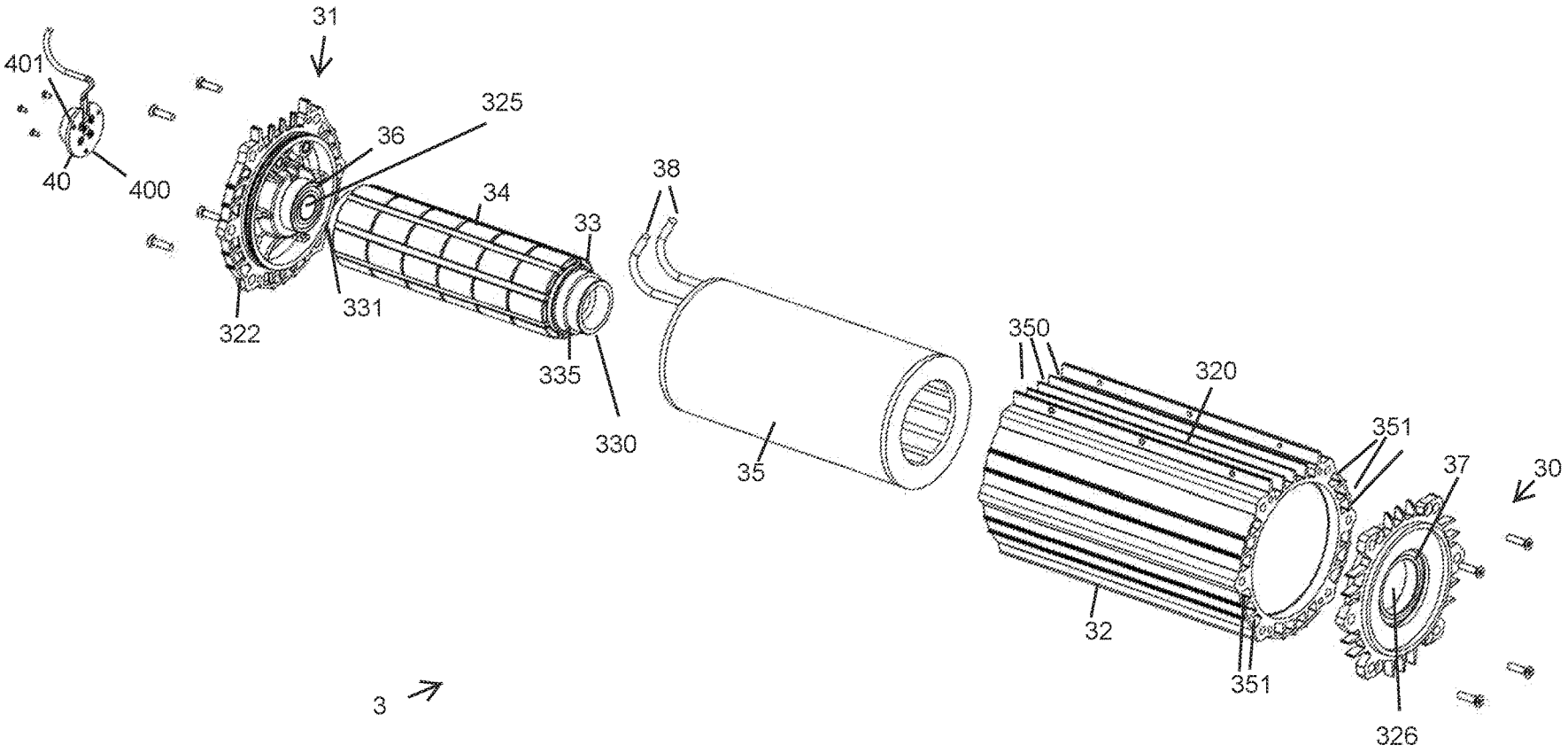
FIG. 5 is a partial exploded view of the motor and cooling system shown in FIG. 1.

Preferred features, embodiments and variations of the invention may be discerned from this section, which provides sufficient information for those skilled in the art to perform the invention. This section is not to be regarded as limiting the scope of any preceding section in any way.

In the figures like reference numerals refer to like parts.

Referring first to FIGS. 1 to 14 and 22 to 24, there is shown an electric drive compressor system 1 that includes a reciprocating compressor 2 having dual temperature and pressure sensors 83, 84, a motor 3 for driving the compressor 2, a cooling system 4 for cooling at least the motor 3, and a controller 5 for controlling the motor 3 and cooling system 4 based on temperature and pressure sensor readings.

The compressor 2 has a front end 20 and a rear end 21 and includes a compressor housing 22 (case), a first discharge valve plate 23, a first gasket 24, a first suction valve plate 25, a first cylinder block 26, five piston assemblies 27, a first thrust bearing 28, ten shoe discs and balls 29,70, a swashplate 71, a compressor drive shaft 72, a locking pin 73, a second thrust bearing 74, a second cylinder block 75, a needle bearing 76, a second suction valve plate 77, a second gasket 78, and a second discharge valve plate 79. This compressor 2 design has largely been described in Japanese patent publication number 60-104783, the entire contents of which are incorporated herein by way of cross-reference.

The compressor housing 22 includes a main cylindrical housing 80 having a cylindrical sidewall and a front cap/front end wall 81 that is fastened to the main housing 80 by way of mechanical fasteners. The compressor 2 has feet 82 that are attached to the main housing 80 by way of mechanical fasteners.

The compressor 2 includes dual pressure and temperature sensors 83, 84 located near a rear end of the compressor housing 21, as well as a gas intake/suction port 85 and a gas discharge port 86 located at a front end of the compressor housing 22.

The compressor housing 22 has various openings for other compressor components such as the dual pressure and temperature sensors 83 (discharge side), 84 (suction side), two sight glasses 87, an oil return port 88, an oil drain plug 89, a relief valve 90, and plugs 91 for the gas intake/suction 85 and discharge ports 86.

The valve plates 23, 25, 77, 79, gaskets 24, 78, cylinder blocks 26, 75, piston assemblies 27, swashplate 71 and compressor shaft 72 etc constitute a working assembly 92 that is situated within the compressor housing 22. The compressor 2 includes a valve plate compartment 93 located between the discharge valve plate 79 and rear end of the compressor housing 21. The valve plate compartment 93 has two sub-compartments, one of which is under high pressure and is in direct fluid communication with the discharge port 86 and one of which is under low pressure and is in direct fluid communication with the intake/suction port 85.

Figure 11:
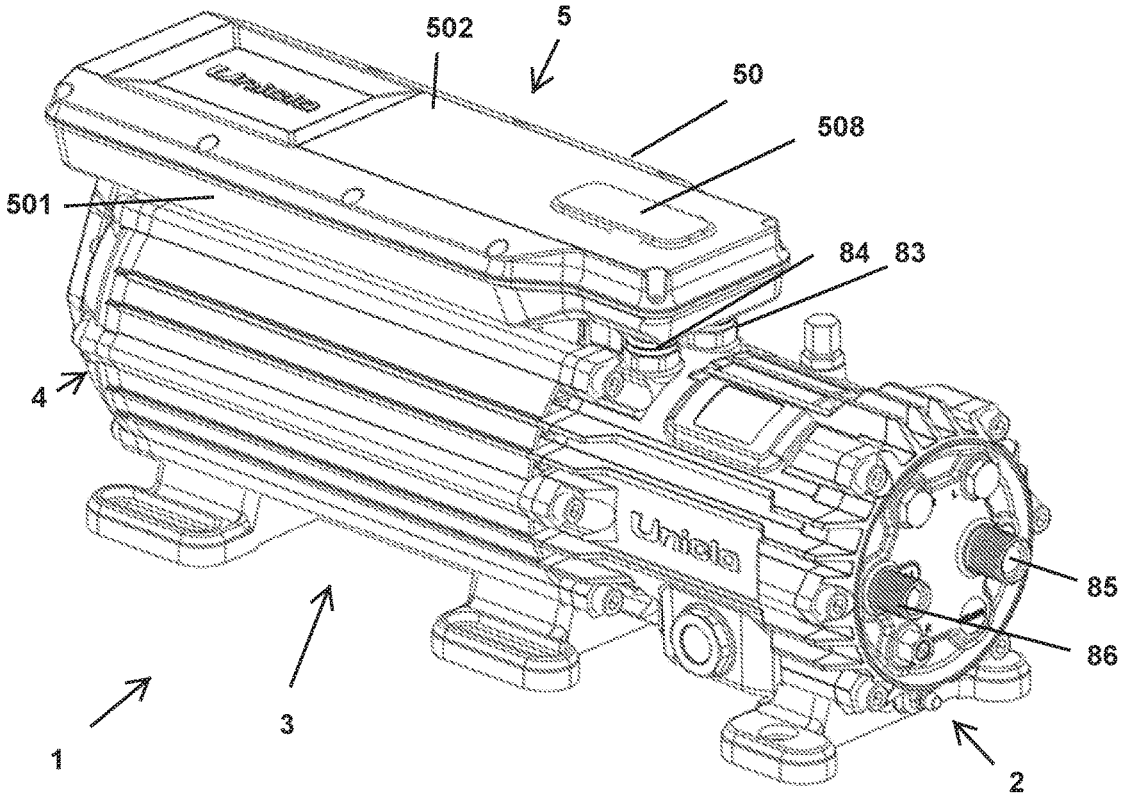
FIG. 11 is a perspective view of the electric drive compressor system of FIG. 1.
Figure 12:
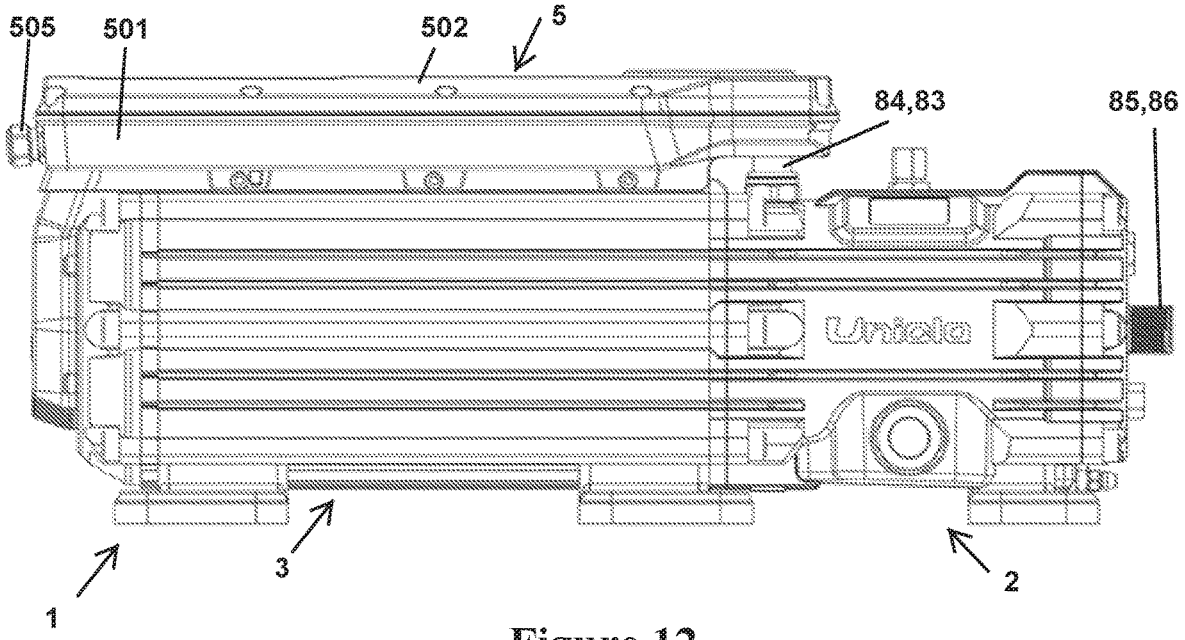
FIG. 12 is a side elevation view of the electric drive compressor system of FIG. 1.

The dual pressure and temperature sensors 83, 84 are, in a preferred embodiment, model number TEM00875 as manufactured by Sensata Technologies. Each sensor 83, 84 includes: a sensing region comprising a thermistor 830, 840 at a lower end of the sensor 83, 84 and a pressure plate 837, 847 located above the thermistor 830, 840; a threaded body 831, 841; and a sensor lead wire/contact 832, 842 that is connectable to the controller 5, as shown in FIGS. 11 and 12. The threaded body 831, 841 of each sensor 83, 84 is received within a respective threaded opening 835, 845 in the main motor body 32. A first sensor monitors the temperature and pressure of gas within one sub-compartment and a second sensor monitors temperature and pressure of gas within the other sub-compartment. In this way, the sensors 83, 84 monitor the temperature and pressure of the incoming (prior to compression) and discharged (after compression) gas/refrigerant.

The swashplate 71 is an elliptical disk that is mounted at an angle to the compressor drive shaft 72. The drive shaft 72 extends through the thrust bearings 28, 74, each of which engages a boss 260, 750 of a cylinder block 26, 75. The drive shaft 72 extends through a central bore 261, 751 of each cylinder block 26, 75. One end 720 of the drive shaft 72 is splined/keyed and extends through a boss 210 of the rear wall of the compressor housing 22 in a sealed manner, for connection to an end of the drive shaft of the motor 3. The other end of the compressor shaft 721 extends within the needle bearing 76, which bearing 76 locates within a central bore 751 of a cylinder block 75.

Each piston assembly 27 includes a pair of axially opposed pistons 271, 272. A head of each piston 271, 272 has a sealing ring 273, 274. Another end of each piston 271, 272 has a socket 275, 276, for receiving a ball 70. Each cylinder block 26, 75 has a cylindrical bore 262, 752 of the cylinder block 26, 75 within which slides a piston 271, 272. The socket end of each piston engages the swashplate 71 by way of a shoe disc 29 and a ball 70 that rides within a socket of the shoe disc 29 and the socket 275, 276 of the piston. The shoe disc 29 (slipper disc) slides on the swashplate 71. As the compressor drive shaft 72 rotates the swashplate 71, the pistons 271, 272 are caused to move in a reciprocating manner parallel with the compressor drive shaft 72 within the cylindrical bores 262, 752. This reciprocating motion draws gas through the intake port 85 and further through the low pressure sub-chamber of the valve compartment 93 and discharges compressed gas through the discharge port 86 via the high pressure sub-chamber of the valve compartment 93.

The compressor housing 22 is fluid-tight and so no gas is able to escape from the compressor 2 to the environment, including into the motor 3.

The compressor housing 22 has radially extending airflow passages in the form of cooling fins 220 that extend parallel with the compressor drive shaft 72. These fins 220 can be part of the cooling system 4.

The motor 3 is most clearly shown in FIGS. 1, 5, 6, 9 and 10, and has a front end 30 and a rear end 31. The motor 3 has a brushless DC motor drive and includes a motor housing 32 having a front end 30 and a rear end 31, a motor drive shaft 33, a rotor 34, a stator (containing winding) 35, first and second bearings 36, 37, and lead wires/contacts 38. A temperature sensor (not shown) is connected to the stator 35 housing. A motor position sensor/speed sensor/Hall-effect sensor (not shown) for monitoring the position/speed of the motor drive is connected to a rear cap/end wall 322 of the motor housing 32.

The motor drive shaft 33 has a hollow cylinder 335 having a front end 330 and a rear end 331. The front end 330 is supported within a ball bearing 37 at the front end 30 of the motor housing 32. The rear end 331 of the hollow cylinder 335 extends around a ball bearing 36 at the rear end of the motor housing 31. The motor drive shaft 33 includes a splined/keyed socket 332 located within the hollow cylinder 335, at the front end 330 of the hollow cylinder 335. The splined/keyed socket 332 is sized to firmly engage with the splined/keyed end 720 of the compressor drive shaft 72.

The motor housing 32 includes a main cylindrical housing 320 having a cylindrical sidewall, a front cap/front end wall 321, a rear cap/rear end wall 322, and feet 323.

Both caps/end walls 321, 322 are fastened to the main housing 320 by way of mechanical fasteners. The feet 323 are connected to the main cylindrical housing 320 by way of mechanical fasteners.

The front end wall 321 of the motor housing has a recess that supports a ball bearing 37. The rear end wall 322 of the motor housing has a boss 325 about which extends a ball bearing 36. The front end wall 321 of the motor housing has a central opening 326 that receives the splined/keyed end 720 of the compressor drive shaft 72 in a sealed manner. The rear wall 322 of the motor housing 32 has a recess 327 adapted to mount a fan motor of the cooling system 4.

Figure 6:
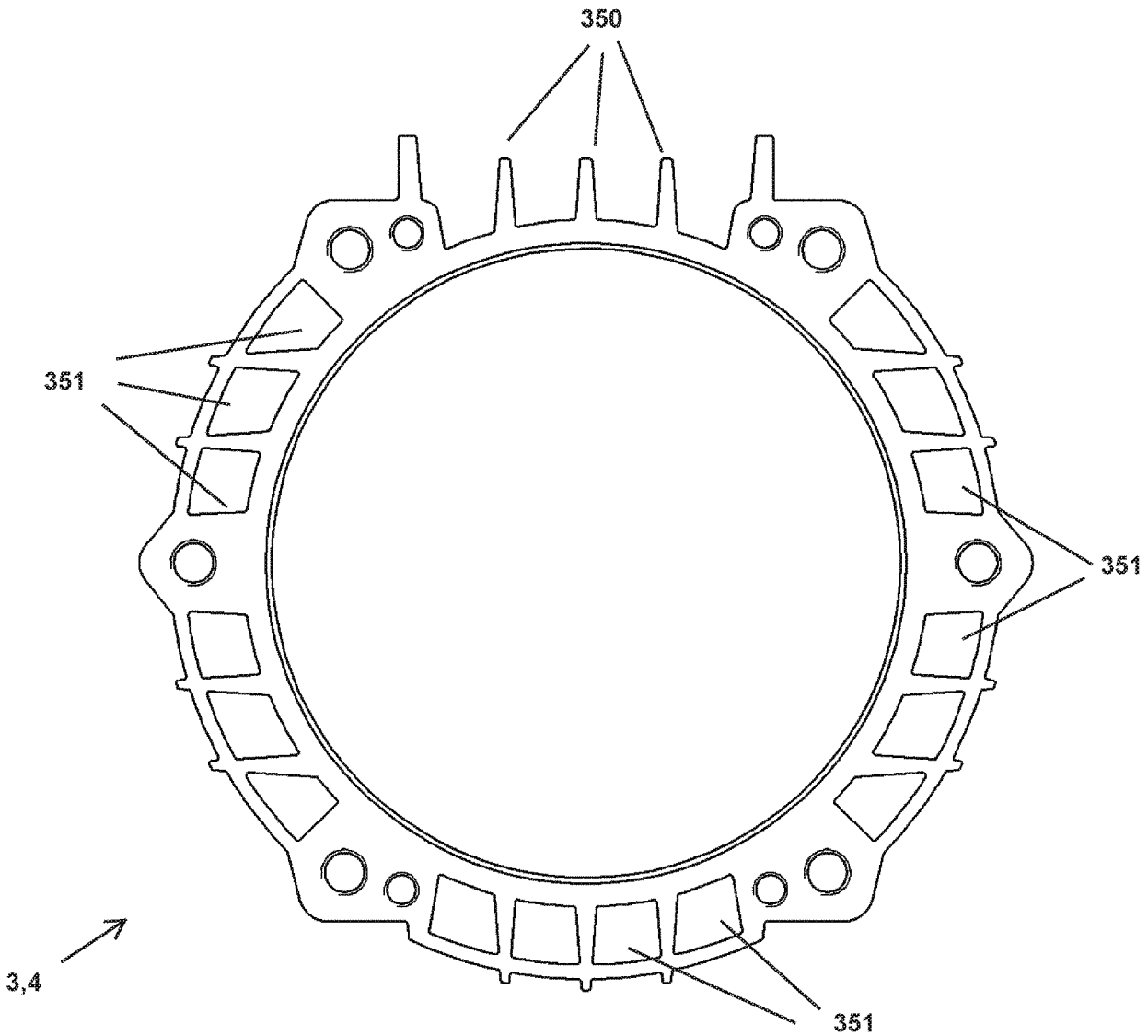
FIG. 6 is an end view showing an exterior region of a rear wall of the motor housing.
Figure 7:
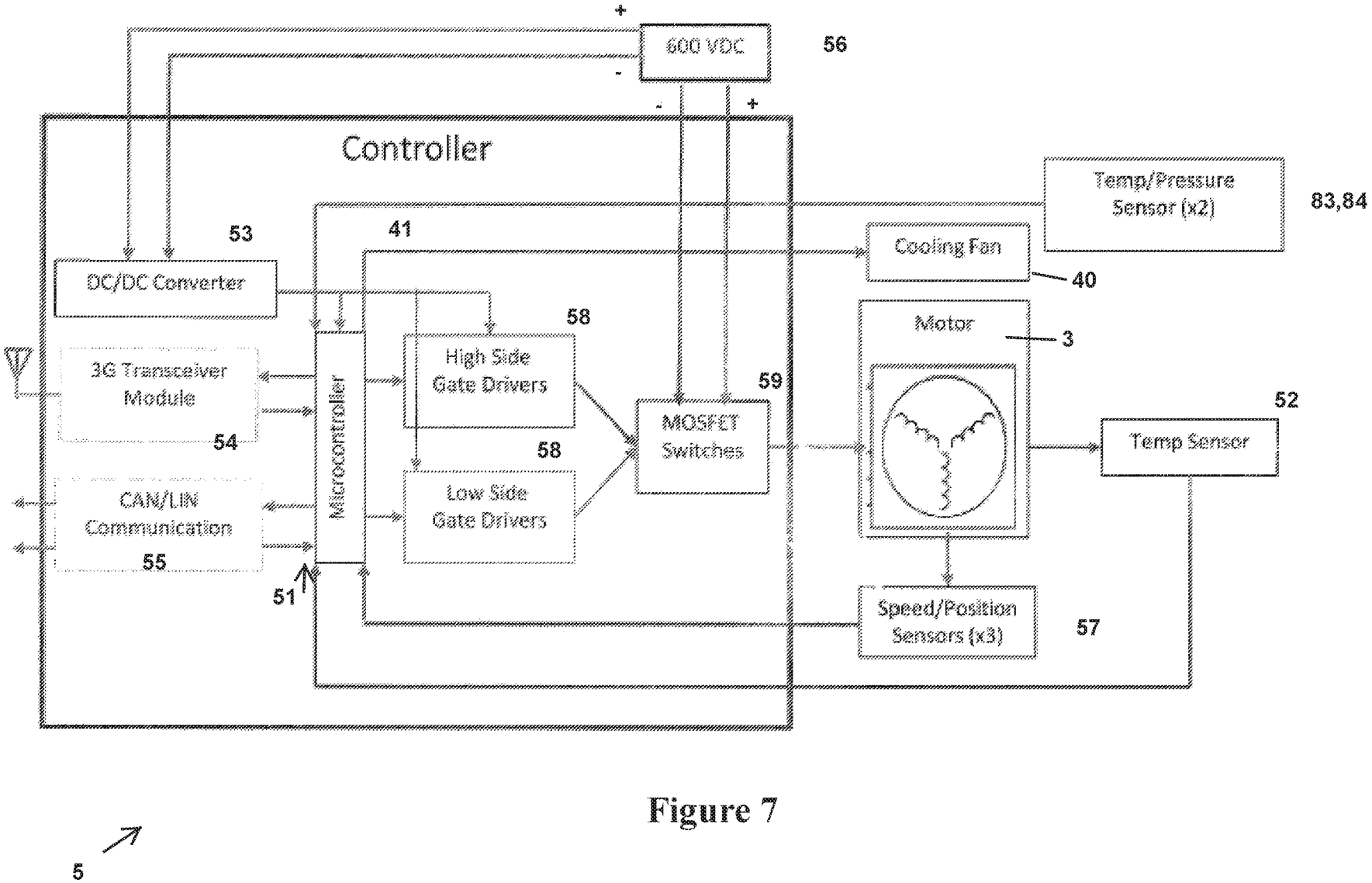
FIG. 7 is a block diagram of an embodiment of the invention, showing the controller.
Figure 9:
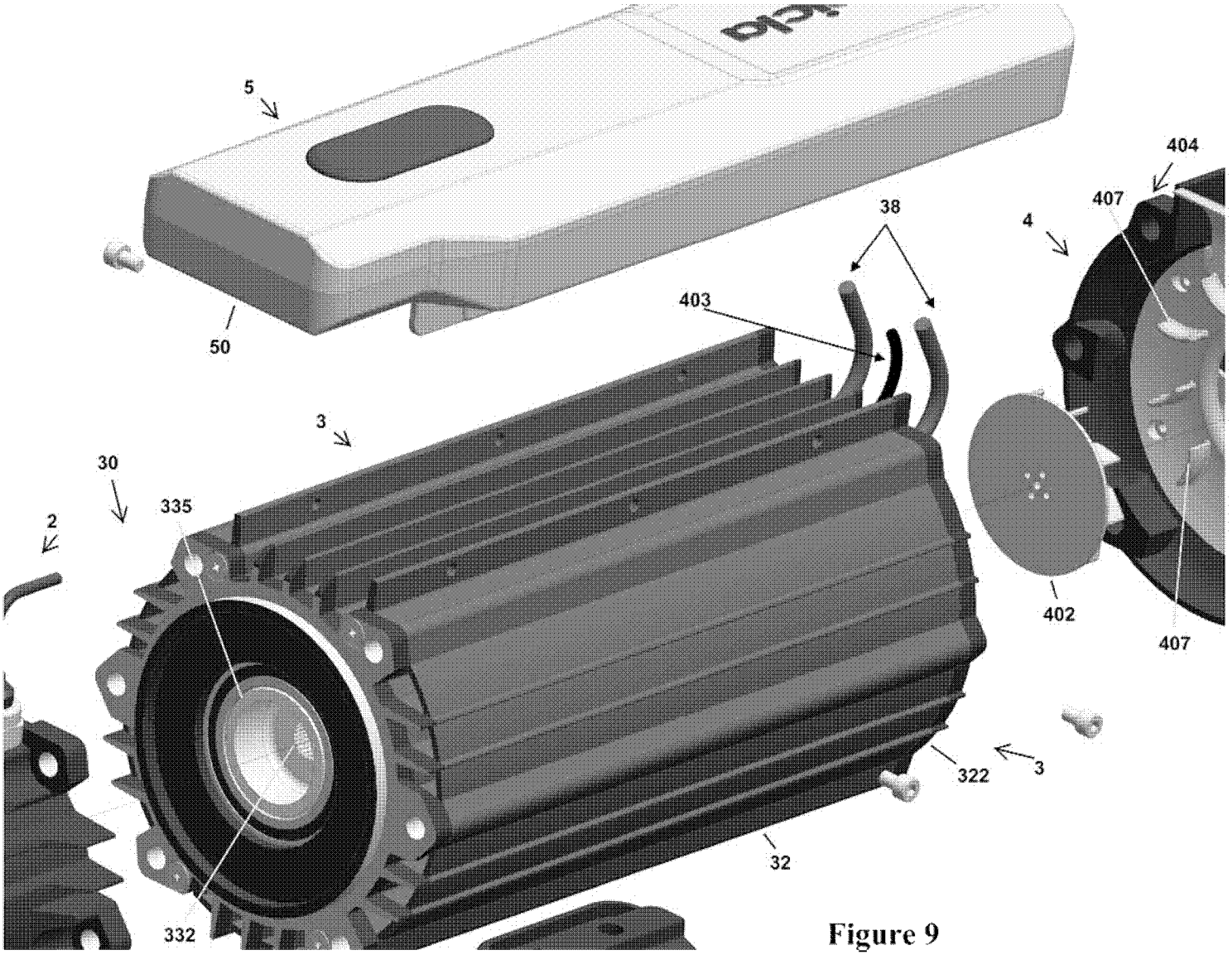
FIG. 9 is a partial exploded view of the compressor assembly shown in FIG. 1.
Figure 10:
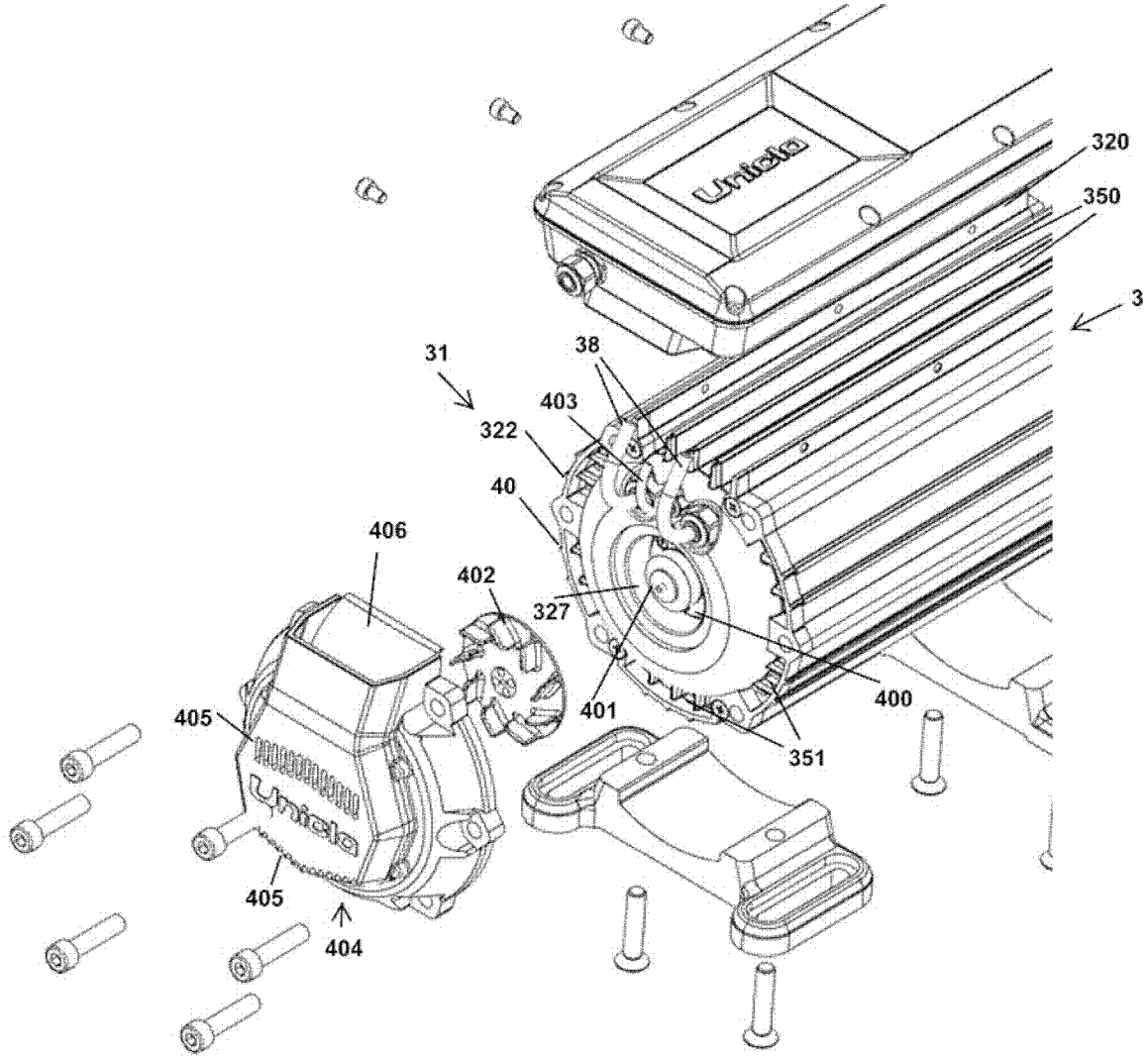
FIG. 10 is a partial exploded view of the motor and cooling system shown in FIG. 1.

The motor housing 32 has airflow passages in the form of radially extending cooling fins 350 and enclosed airflow passages 351 that extend substantially parallel with the motor drive shaft 33 through which cooling air can flow. When viewed on end, the motor housing's exterior/perimeter is similar to a honeycomb structure with airflow passages 350, 351 resembling cells of a honeycomb, as seen in FIGS. 6, 9 and 10. A housing of the controller 5 and fins 350 create further airflow passages, similar to those numbered 351. The airflow passages 350, 351 can be part of the cooling system 4.

The motor 3 is controlled by the controller 5. Motor lead wires/contacts 38 extend from the controller 5 to the stator 35 via the rear end wall 322, as seen in FIG. 10. When powered, the rotor 34 and motor drive shaft 33 rotate within the stator 35, and the motor drive shaft 33 turns the compressor drive shaft 72.

The motor housing 32 can be disconnected from the compressor housing 22. Mechanical fasteners (nuts and bolts) are secured through eyelets of the compressor main housing 80 and passages of the motor housing 320.

If using a flammable refrigerant, then the motor 3 can have an additional drive shaft seal (not shown) that extends around the drive shaft 33 of the motor 3 at the front end 30 of the motor housing 32. This additional seal prevents flammable gas from reaching electronic components of the motor 3.

The cooling system 4 includes a fan 40, fan control 41 and housing cooling arrangement that includes the airflow passages 351 and 350 of the motor housing, the airflow passages 220 of the compressor housing 22, and the airflow passages/downwardly extending fins (not shown) of the controller housing 50.

As best seen in FIGS. 1, 5, 9 and 10, the fan 40 includes a mounting base plate 400, motor 401 having a drive shaft, impeller 402 and lead wire/contact 403. The mounting base plate 400 is mounted within the rear wall 322 of the motor housing by way of mechanical fasteners. The motor 401 is situated between the base 400 and the impeller 402. The drive shaft of the motor 401 engages a central opening in a hub of the impeller 402, and the impeller 402 spins within an annular groove of the rear wall 322. Blades of the impeller 402 are orientated so as to force air into the airflow passages 350, 351 of the motor housing 32. The fan lead wire/contact 403 extends through the rear end wall 322 of the motor housing.

Figure 13:
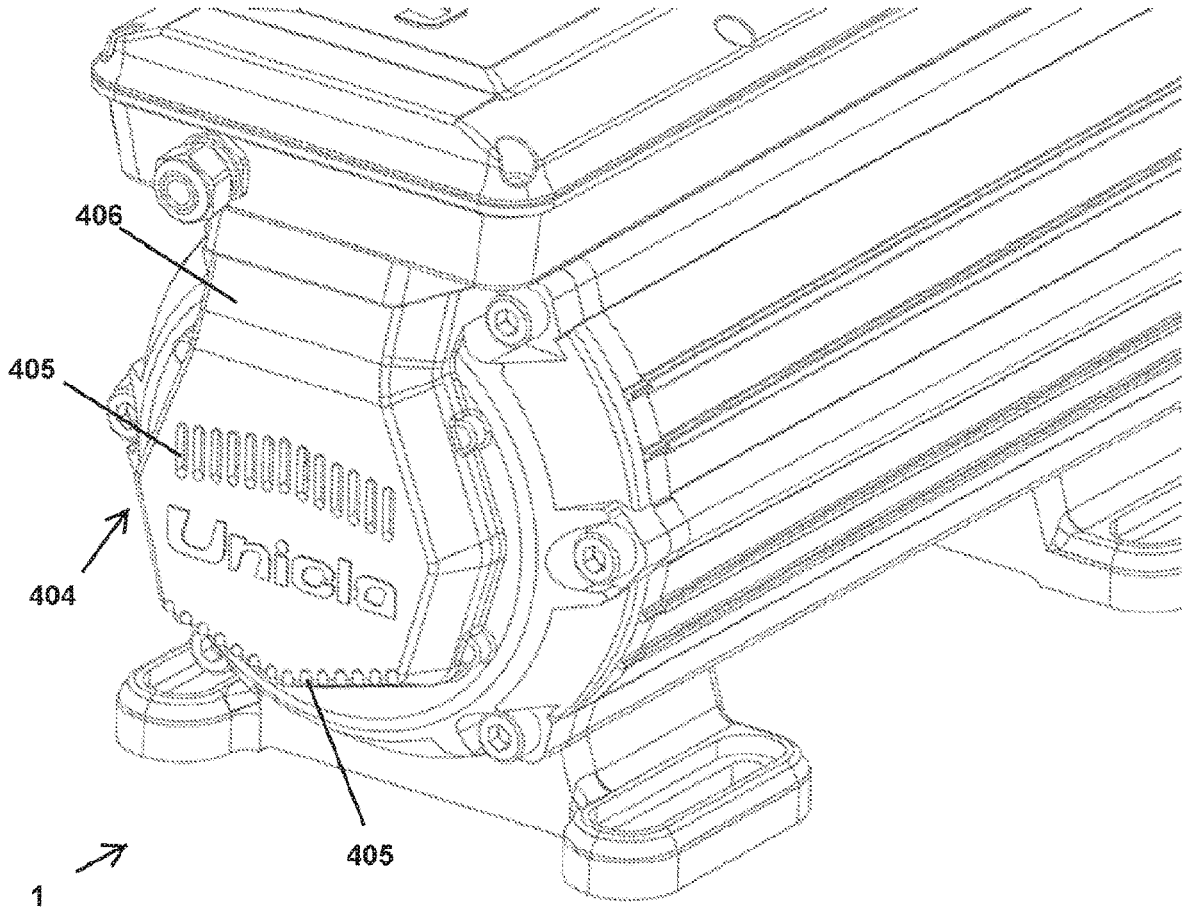
FIG. 13 is a rear perspective view of part of the system shown in FIG. 12.
Figure 14:
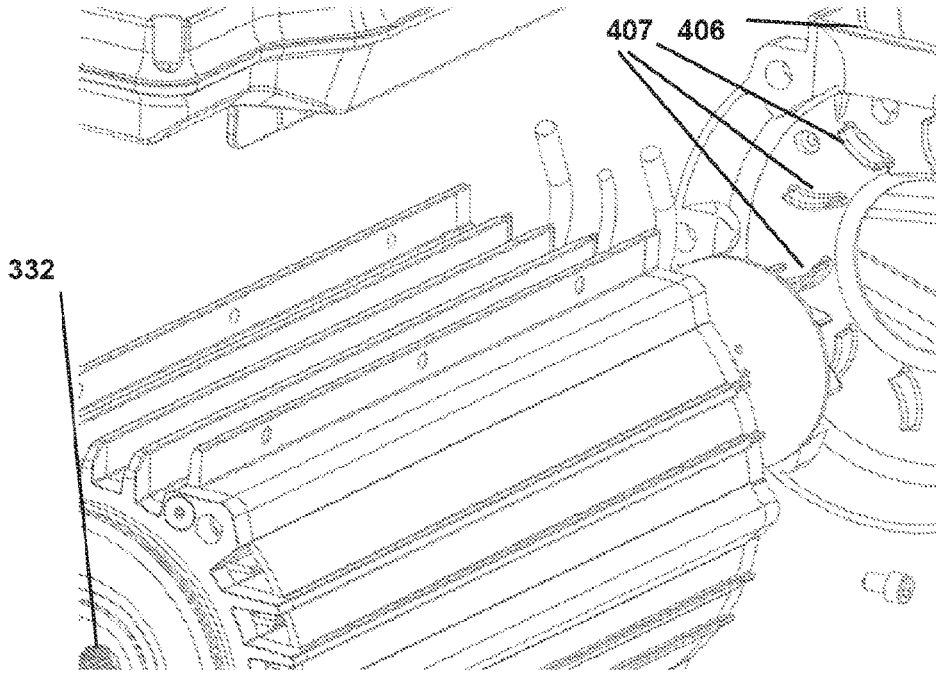
FIG. 14 is a perspective view of part of the motor housing, controller and fan cover shown in FIG. 1.

The housing cooling arrangement includes a fan cover 404 that extends over the impeller 402 and is connected to the rear end wall 322 of the motor housing 32 by way of mechanical fasteners. The fan cover 404 has air inlets 405 in the form of a grill for drawing in air (at ambient temperature) from outside the fan cover 404. The fan cover 404 has air discharge guide vanes 407 and a chute 406 for directing that air into the airflow passages 350 and 351, as seen in FIGS. 10, 13 and 14. Air is directed through the airflow passages 350, 351 that are located about a periphery of the motor housing 32, including between a top of the motor housing 32 and a housing 50 and fins (not shown) of the controller 5, as best seen in FIGS. 6, 9 and 13.

When the fan 40 is operated, cooling air is drawn within the inlets 405 and the impeller 402 plus air discharge guide vanes 407 and chute 406 direct the cooling air through the airflow passages 350, 351 and further between the airflow fins 220 of the compressor housing 80. In this way, both the motor 3 and the compressor 2 are cooled by that air. Also, electronics of the controller 5 are cooled by airflow between the fins 350 and the controller housing 50 and its fins. No refrigerant is sacrificed by passing it through the motor housing 32, as would be done conventionally.

The fan cover 404 includes baffles 409 located between the air inlets 405 and fan motor 401, for preventing water entering the fan cover 404 from reaching electronic componentry of the fan or motor.

Referring now to FIGS. 1, 7, 9, 10, 11, 12, 13, 22 and 24, the controller 5 includes a controller housing 50, a microcontroller 51 (or other logic circuitry), contacts/electrical sockets for the wire leads/contacts of the dual temperature and pressure sensors 83, 84 for engagement of the sensors with the controller housing 50, a temperature sensor 52 (located on the stator housing) for sensing the temperature of the motor 3, contacts/electrical sockets for the motor wire/contacts 38 and fan lead wires/contacts 403, a DC to DC converter 53, a transceiver module 54, a CAN/LIN communication interface 55, power amplifiers, power level shifters, transistors and other circuitry. The controller 5 is connectable to a power supply 56 via the DC/DC converter 53. The controller housing 50 is connectable to the motor housing 32 by way of mounting fins and mechanical fasteners (see the mounting screws and controller housing tabs that receive those screws in FIG. 12).

Figure 24:
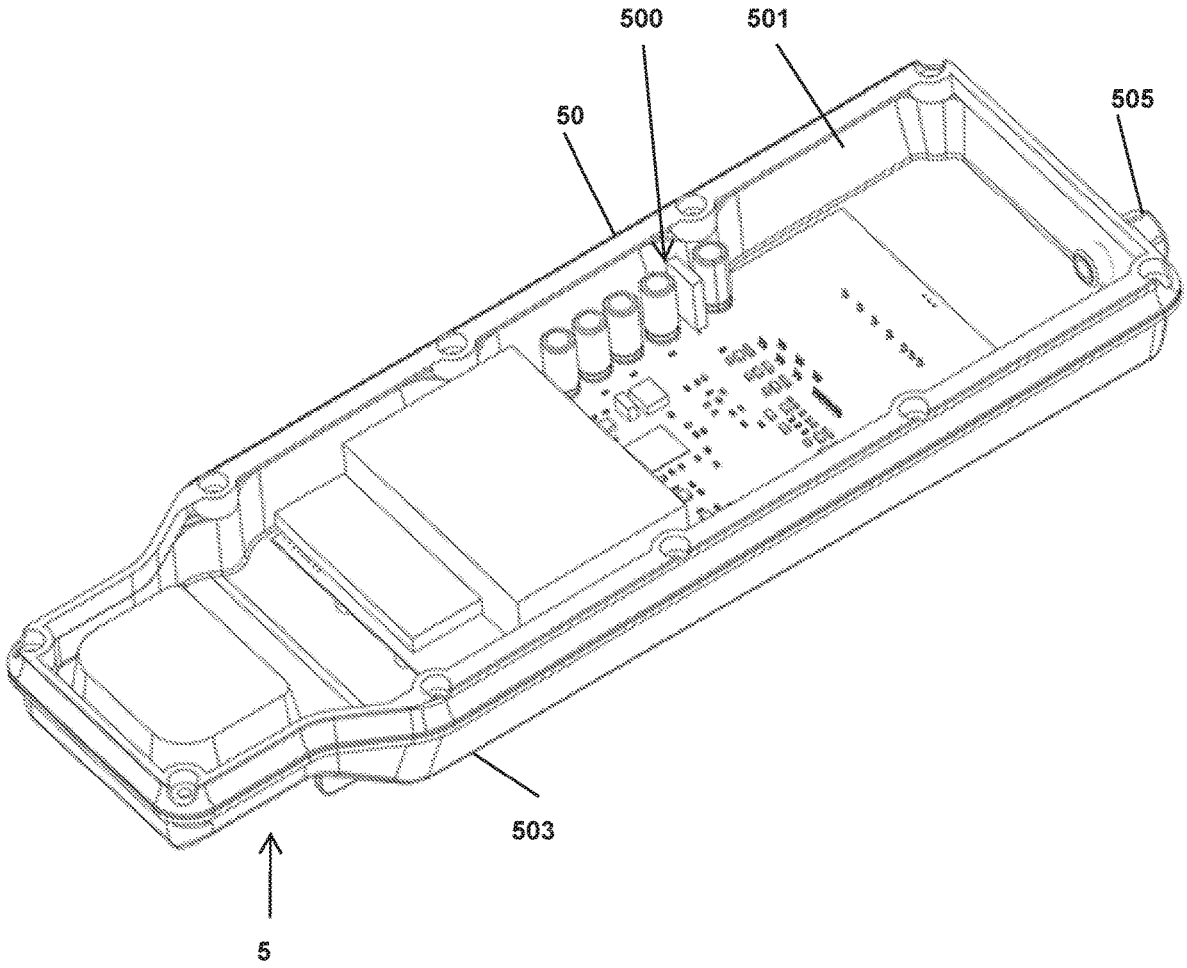
FIG. 24 is a perspective view of what is within the controller housing of the system shown in FIG. 1.

The controller housing 50 contains the electronic circuitry and components 500, as seen in FIG. 24. The controller housing 50 has a side wall 501, a flattened top wall 502 and a bottom wall 503. The top wall 502 is removable, as seen in FIG. 24. The side wall 501 has an opening 505 through which extends a power cord (not shown) in a substantially sealed manner. Cooling fins (not shown) extend downwardly from the bottom wall 503. The bottom wall 503 has openings (not shown) for the fan, motor and sensor lead wires or contacts 832, 842, 38, 403. The top wall 502 has a polycarbonate area corresponding to an antennae 508 of a transceiver module 54.

The controller 5 includes a microcontroller 51 electrically connected to the dual temperature and pressure sensors 83, 84, for receiving input from those sensors 83, 84. The microcontroller 51 is electrically connected to a temperature sensor 52 associated with the motor 3, for receiving input from that sensor 52. The microcontroller 51 is electrically connected to speed/position sensors 57 associated with the motor 3 for receiving input from those sensors 57.

The microcontroller 51 is electrically connected to the cooling fan 40, via fan control 41, for managing the rotational speed of the cooling fan 40. The fan control 41 utilises pulse-width modulation to provide control signals to the cooling fan 40.

The microcontroller 51 has motor speed control for managing the rotational speed of the motor 3. The motor speed control employs power amplifiers and transistors in the form of high and low side gate drivers 58 and MOSFET 59 switches.

The controller 5 is connected to 600 VDC and includes a DC to DC converter 53. The DC to DC converter 53 is connected to the high side gate drivers 58 and microcontroller 51. The 600 VDC 56 is connected to the MOSFET switches 59 to provide voltage thereto.

The controller 5 includes a wireless (3G or 4G) transceiver module 54 for both transmitting and receiving data wirelessly between the microcontroller 51 and a remote device, such as a PC, website or other user interface. The antennae 508 of the transceiver module is located within the top wall 502 of the controller housing 50.

The control 5 includes a CAN/LIN communication interface 55, enabling communication between the microcontroller 51 and other applications/devices/user interface/server/receiver.

The system 1, as exemplified, enhances compressor performance during normal system operation and provides protection in unfavourable conditions or from a specific system fault.

The system uses logic control to protect the compressor 2 from excessive pressure and thermal loads, and can be customised across a range of discharge and suction side pressures, and thermal parameters. In addition to baseline parameter settings, the controller software/firmware can be pre-programmed to the type of refrigerant, compressor size and system designed to enhance compressor performance and protection specific to the characteristics of the relative refrigerant.

The controller 5 is configured with logic designed to process the parameters obtained by the sensors 83, 84, 52 and 57, and control operating parameters to ensure desired operation of the system. Through the reconfigurable software of the controller 5, safety and operational parameters can be set for the suction and discharge pressures, excessive compressor body temperatures, excessive suction line and discharge superheat. This functionality gives an end user the ability to tailor or fine tune the controller 5 and overall system.

Figure 15:
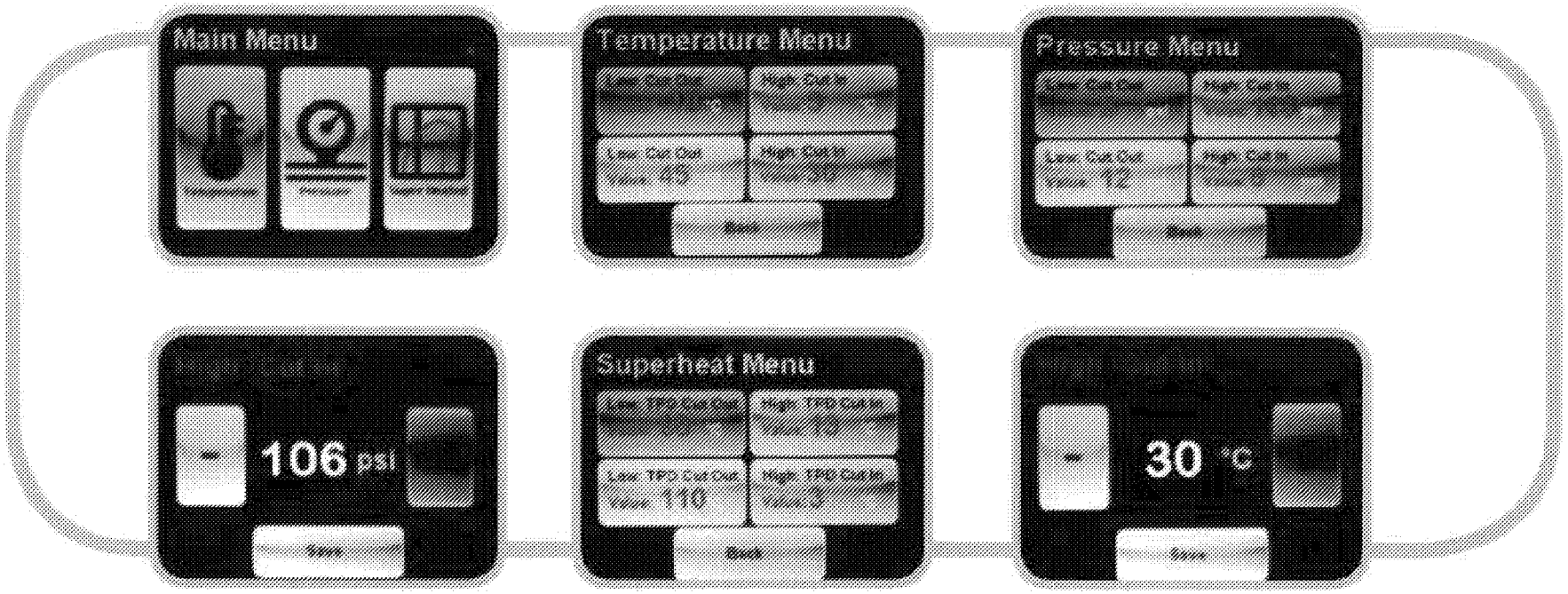
FIG. 15 are images of a user interface of the system of FIG. 1.
Figure 22:
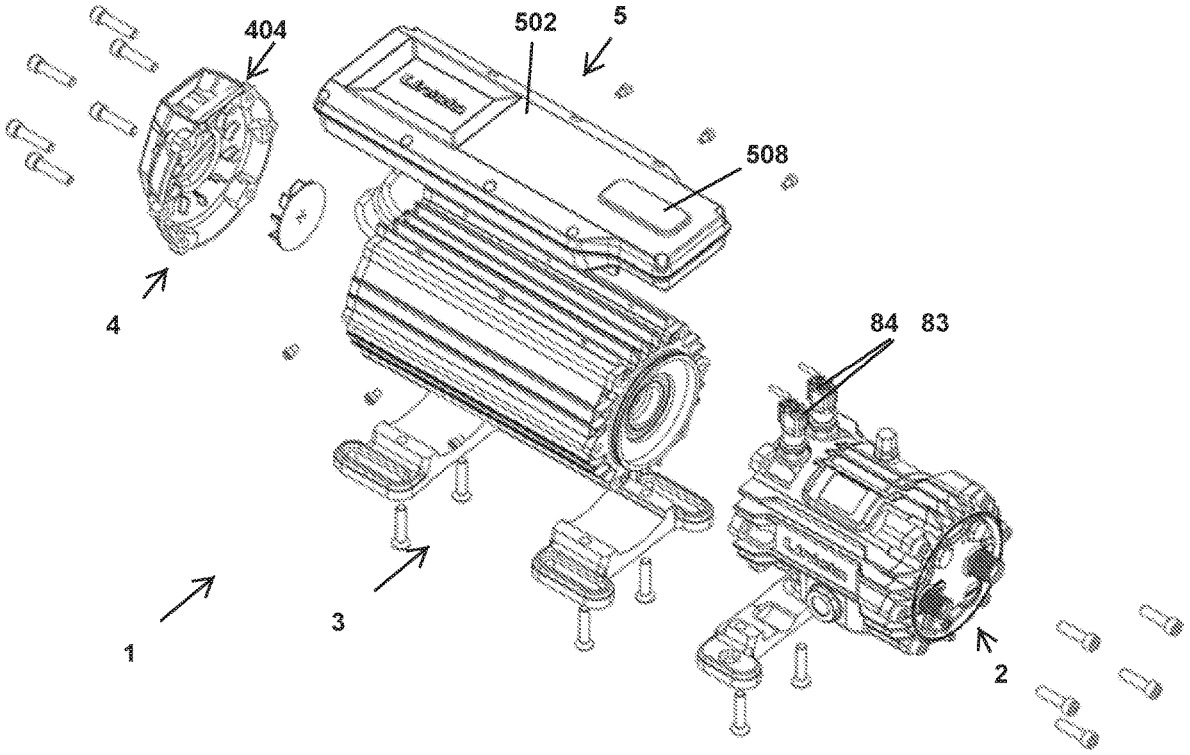
FIG. 22 is another partially exploded view of the electric drive compressor system shown in FIG. 1.
Figure 23:
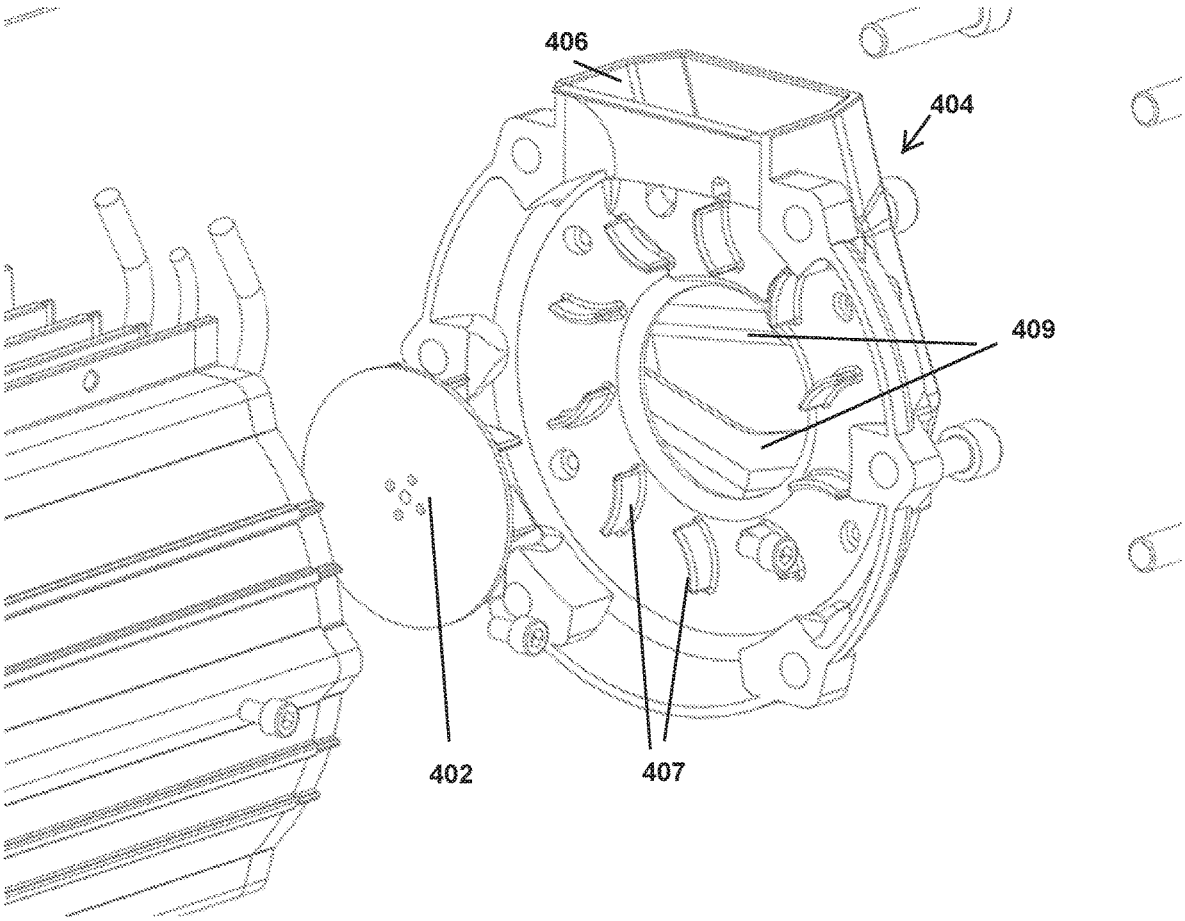
FIG. 23 is a partial exploded view of part of the compressor system shown in FIG. 1.

Connection to the controller 5 can be made via CAN bus (Controller Area Network), LIN bus (Local Interconnect Network) connections 55 to allow (substantially) real time viewing of compressor 2 parameters and operation. The 3G/4G transceiver module 54 provides online connection and data transmission to a web interface or other web portal as required. Images of the user interface are shown in FIG. 15.

The dual temperature-pressure sensors 83, 84 are used to simultaneously measure the pressure and temperature of the gas at both the high and low side of the compressor 2, from the top of the valve plate 79. Sensor data is transferred to the controller 5 and a series of predefined commands, as shown in the flowchart of FIG. 8, will adjust the compressor 2 to optimise its performance.

Figure 8:
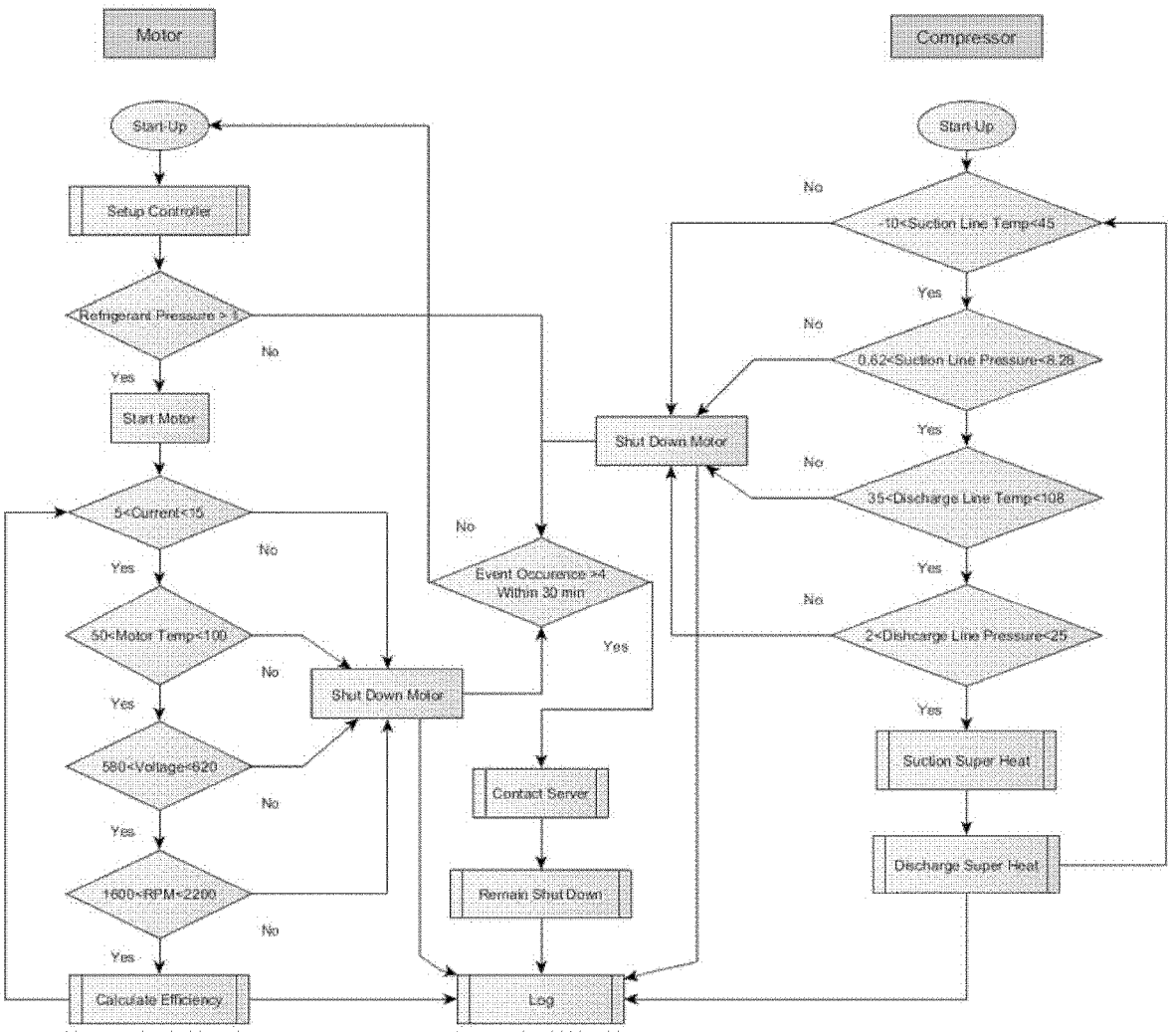
FIG. 8 is an operational flowchart of the controller, relating to maximum running conditions.

Maximum running conditions are shown in the flowchart of FIG. 8. Operating parameters to be used by the controller 5 are configured by way of a user interface in wireless communication with the controller 5 via the 3G/4G transceiver module 54. The controller receives an indication of the refrigerant/gas pressure via the temperature/pressure sensors, then a control signal is sent to start the motor 3. The motor's temperature is monitored via the temperature sensor 52, and the speed of the motor is modified via the MOSFET switches 59 as required.

The compressor 2 is started. The temperature and pressure of the suction line and discharge line are monitored by the temperature/pressure sensors 83 and 84, respectively. The controller 5 modifies the motor's speed as required to ensure optimal operating conditions.

The electric drive compressor systems as exemplified can utilise 10 or 14 cylinder swashplate technology, and have a capacity ranging from 150 cc to 680 cc. These have a specific electric drive motor with either brushless DC (BLDC) or switch reluctant (SRM) variations, available in 750 VDC, 600 VDC or 24 VDC configurations, and are compatible with refrigerants such as R134a, R404a, R452a and R1234yf.

The electric drive compressor system 1 is usually connected into a refrigerant circuit containing refrigerant and operated by way of the following steps:

1. Hoses of the circuit are connected to the intake/suction and discharge ports of the compressor.
2. Compressor oil checks are carried out, checking for leaks at the compressor connections and other connections.
3. Air is evacuated from the refrigerant circuit using a vacuum pump.
4. A charging step is utilised, whereby the system is filled with a final refrigerant via an approved point in the refrigerant circuit, in accordance with manufacturer recommendations and following ISO and ASHRAE.
5. The controller is connected to a remote receiver such as a user interface, PC, web portal, laptop or Android system using a wireless connection or wired connection (eg. Bluetooth, USB, LIN, CAN or USB connection).
6. Software/firmware is run on the remote receiver.
7. A user interface is utilised to enter system parameters and checking and/or changing pressure and temperature settings to ensure that they are in line with manufacturer recommendations for the refrigerant circuit that the electric drive compressor system is connected to.
8. The current refrigerant pressure level is checked to ensure that the system is ready to commission/switch on.
9. Pressure and temperature data from the compressor sensors are monitored at the same time, in real-time.
10. The controller decides whether to turn the motor on or off, or to run the motor at a different speed. In turn, this will affect the compressor's speed.
11. Temperature reading are taken of the motor, and the controller decides whether or not to cool the motor.
12. The fan control receives pressure and temperature data from the intake/suction and discharge ports of the compressor at the same time, and the controller makes a decision based on that data whether to turn the cooling fan on or off, or to run the fan at a specific speed.
13. The motor control and fan control steps are carried out simultaneously in real-time based on temperature and pressure data coming from the sensors of the compressor.

These systems 1 as exemplified (see also the systems 1 in FIGS. 16 to 21) are small and lightweight, and hence are highly portable and compact. They have a uniquely designed housing cooling system assisted by a PWM controlled fan at the rear of the motor. The fan operates independently of the motor. That is, the motor driveshaft does not drive the fan.

The motor and compressor can be separated from each other without interrupting the refrigerant circuit.

The motor can have an additional drive shaft seal should the refrigerant be flammable.

The systems 1 are ideal for mobile air-conditioning and refrigeration applications where electricity supply is a prime source of power. This includes rail, mining, electric bus and industrial applications.

Features and advantages of the systems 1 as exemplified are as follows:

- lightweight and compact design
- refrigerant circuit sealed from electric motor for ease of maintenance and service
- air cooled from unique fin and airflow passage design, with fan width pulse width modulation
- intelligent control system with pressure-temperature sensors/transducers and software
- separate compressor working assembly to ensure piston alignment and compression is not affected by heat distortion
- separate outer housing and compressor crankcase to ensure leak free operation
- smooth operation and high volumetric efficiency from 10 and 14 cylinder swashplate working assemblies
- heavy duty impressed steel gaskets, high-temperature O-rings and double lip shaft seal
- CAN and LIN connectivity with modem for online data and web transmission In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An electric drive compressor system comprising:

a swashplate compressor having:

a compressor housing with a front end and a rear end;

a gas intake/suction port and a gas discharge port located at the front end of the compressor housing;

a valve plate compartment having a high pressure sub-compartment which is in direct fluid communication with the gas discharge port and a low pressure sub-compartment which is in direct fluid communication with the gas intake/suction port; and a first dual temperature and pressure sensor and a second dual temperature and pressure sensor located near the rear end and inside of openings of the compressor housing, the first dual temperature and pressure sensor has at least sensing region located within the low pressure sub-compartment for sensing the temperature and pressure of the gas in the low pressure sub-compartment, the second dual temperature and pressure sensor has at least sensing region located within the high pressure sub-compartment for sensing the temperature and pressure of the gas in the high pressure sub-compartment, such that the first dual temperature and pressure sensor and the second dual temperature and pressure sensor simultaneously sense the pressure and temperature of the gas prior to and after compression by the compressor;

a motor connected to the compressor for driving the compressor;

a cooling system for cooling the motor, said cooling system comprises a fan connected to the motor and operated independently of the motor, a fan control, and a housing cooling arrangement for cooling at least the motor, and the fan control simultaneously receives the readings from the first dual temperature and pressure sensor and the second dual temperature and pressure sensor; and a controller comprising a microcontroller, contacts/electrical sockets electrically connected to the first dual temperature and pressure sensor and the second dual temperature and pressure sensor for receiving readings therefrom, and contacts/electrical sockets respectively for the motor and the fan, and wherein the controller simultaneously control the motor and fan in real time based on the simultaneously taken readings of the first and second dual temperature and pressure sensors of the gas prior to and after compression by the compressor.

2. The electric drive compressor system according to claim 1, wherein the motor drives the compressor in a manner such that the motor and compressor be separated from each other without interrupting a refrigerant circuit of the compressor, wherein said compressor comprises a compressor drive shaft seal that extends around a drive shaft of the compressor and prevents leakage of refrigerant from the compressor, and wherein said motor comprises a motor drive shaft seal that extends around a drive shaft of the motor and prevents ingress of refrigerant.

3. A method of operating an electric drive compressor system comprising:

a swashplate compressor having:

a compressor housing with a front end and a rear end;

a gas intake/suction port and a gas discharge port located at the front end of the compressor housing;

a valve plate compartment having a high pressure sub-compartment which is in direct fluid communication with the gas discharge port and a low pressure sub-compartment which is in direct fluid communication with the gas intake/suction port; and a first dual temperature and pressure sensor and a second dual temperature and pressure sensor located near the rear end and inside of openings of the compressor housing, the first dual temperature and pressure sensor has at least sensing region located within the low pressure sub-compartment for sensing the temperature and pressure of the gas in the low pressure sub-compartment, the second dual temperature and pressure sensor has at least sensing region located within the high pressure sub-compartment for sensing the temperature and pressure of the gas in the high pressure sub-compartment, such that the first dual temperature and pressure sensor and the second dual temperature and pressure sensor simultaneously sense the pressure and temperature of the gas prior to and after compression by the compressor;

a motor connected to the compressor for driving the compressor; and a cooling system for cooling the motor, said cooling system comprises a fan connected to the motor and operated independently of the motor, a fan control, and a housing cooling arrangement for cooling at least the motor, and the fan control simultaneously receives the readings from the first dual temperature and pressure sensor and the second dual temperature and pressure sensor; and a controller comprising a microcontroller, contacts/electrical sockets electrically connected to the first dual temperature and pressure sensor and the second dual temperature and pressure sensor for receiving readings therefrom, and contacts/electrical sockets respectively for the motor and the fan, wherein said method comprises the step of using the controller to simultaneously control a switch on, shut down and speed of the motor and fan in real time based on the simultaneously taken readings of said first and second dual temperature and pressure sensors of the gas prior to and after compression by the compressor.

* * * * *